US005087001A

United States Patent [19]

Bolli et al.

[11] Patent Number: 5,087,001

[45] Date of Patent: Feb. 11, 1992

[54] ACTUATING DEVICE IN A TOY TRACK ASSEMBLY

[75] Inventors: Peter Bolli, Steinhausen; Philippe Kunz, Baar; Heinz Looser, Baar; Werner Tanner, Baar, all of Switzerland

[73] Assignee: Interlego A.G., Baar, Switzerland

[21] Appl. No.: 617,412

[22] Filed: Nov. 21, 1990

Related U.S. Application Data

[63] Continuation of Ser. No. 286,635, Dec. 19, 1988, abandoned.

[30] Foreign Application Priority Data

Dec. 31, 1987 [CH] Switzerland ..... 5127/87

[51] Int. Cl.[5] ..... A63H 18/02; A63H 19/32

[52] U.S. Cl. ..... 246/327; 246/338; 246/415 A

[58] Field of Search ..... 246/415 A, 270 A, 274, 246/314, 327, 333, 334, 332, 338, 351, 352; 104/53; 238/10 B, 10 E, 123

[56] References Cited

U.S. PATENT DOCUMENTS

| | | | |
|---|---|---|---|
| 650,092 | 5/1990 | Nash | 246/327 |
| 811,160 | 1/1906 | Mann | 246/338 |
| 988,857 | 4/1911 | Brett | 246/327 |
| 1,051,422 | 1/1913 | Rue | 246/327 |
| 1,265,200 | 5/1918 | Guthrie | 246/327 |
| 1,566,492 | 12/1925 | McGinness | 238/123 X |
| 3,316,401 | 4/1967 | Cramer | 246/415 A |

FOREIGN PATENT DOCUMENTS

| | | |
|---|---|---|
| 30233 | 5/1969 | Australia . |
| 0254679 | 1/1988 | European Pat. Off. . |
| 916936 | 8/1954 | Fed. Rep. of Germany . |
| 1007678 | 5/1957 | Fed. Rep. of Germany . |
| 1478403 | 8/1969 | Fed. Rep. of Germany . |
| 2204916 | 8/1973 | Fed. Rep. of Germany . |

*Primary Examiner*—Matthew C. Graham

*Attorney, Agent, or Firm*—Kane, Dalsimer, Sullivan, Kurucz, Levy, Eisele and Richard

[57] ABSTRACT

A switch point for a toy cog railway which has smooth tracks with a centrally disposed gear rod comprising a shifting device with a curved and a straight gear rod piece for the given driving direction. The shifting device which supports these gear rod pieces is laterally displaceable with respect to the track direction. Each obtusely travelled end segment of the switch point is provided with a tongue-like actuating element displaceably disposed in a longitudinal slot of the solid gear rod of the corresponding end segment having an upwardly extending nose. In the outermost position of the actuating element the nose protrudes beyond the gear rod and in the inner position thereof it is lowered to the level of the gear rod. Each actuating element is coupled to a rotating mounted disk by way of pivoted levers, which in turn are coupled with the shifting device. A vehicle which travels on the switch point actuates the nose, if the same protrudes.

30 Claims, 15 Drawing Sheets

ACTUATING DEVICE IN A TOY TRACK ASSEMBLY

This is a continuation of copending application Ser. No. 07/286,635 filed on Dec. 19, 1988 now abandoned.

BACKGROUND OF THE INVENTION

The present invention relates to an actuating device in a toy-track assembly for the mechanical shifting of a track shifting device by a vehicle travelling on a track segment in a defined travelling direction. Such a track shifting device may be contained in a switch point, in a known manner. In the case of a track assembly with rails for sets of vehicle wheels the shifting device conventionally consists of a tongue device which in its simplest embodiments is manually actuated by means of a linkage.

When a vehicle travels on one of the two branches in the direction towards the switch point it is usually required that the tongue device be brought into a position which permits the smooth travelling past the switch point. In real track assemblies as well as in some toy-track assemblies where the associated vehicle is relatively heavy a shifting of the tongue device into a position which enables the smooth travelling past the switch point is not necessary since the first set of vehicle wheels opens the tongue forcibly for the corresponding direction, that is, it "cuts open" the switch point. However, such a forcible actuation of the switch point cannot be attained in a toy-track assembly if the vehicle is light weight and/or if excess friction or other hindrances of the tongue prevent its smooth movement. In such cases a derailing is almost unavoidable.

In addition, the afore-mentioned forcible actuation of the switch point cannot be realized if the track does not have rails or if the track is provided with additional elements for the movement of a vehicle such as a cog railway.

SUMMARY OF THE INVENTION

It is therefore an object of the present invention to provide an actuating device of the afore-mentioned type which causes an automatic shifting of the track-shifting device in a safe and quick manner.

A further object of the invention is to provide such an actuating device for a switch point which can be shifted automatically by the vehicle and manually, if required, in such a manner that an unobstructed passing over the switch point is made possible for the vehicle, even if the track assembly is provided with geared longitudinal elements, such as a cog rack.

Another object is to provide such an actuating device which may be economically manufactured from simple, reliable parts.

A still further object of the invention is to provide such an actuating device for a crossing of a track assembly which is provided with geared longitudinal elements in such a manner that the track piece which is provided with the geared longitudinal element in the crossing is brought into a position enabling the travelling of the vehicle past the crossing.

The above and other objects are attained in accordance with one aspect of the present invention by providing an actuating device for a toy track assembly having a track shifting device which includes at least one actuating element which protrudes beyond the track and is displaceably mounted in a longitudinal direction with respect to the track. The actuating element is connected by coupling elements with the track shifting device and with a reverse shifting device. The actuating device is mounted in a guide which extends in the longitudinal direction of the track. The guide governs the level of the actuating device above the track. In an extended position the actuating element is raised above the track for engagement by a vehicle. As the actuating device is pushed inwards by the vehicle, it is lowered at least to the level of the track out of engagement by the vehicle.

In another aspect of the invention there is provided a switch point for a toy-track assembly. The switch point comprises at least three end segments with a stationary guide element section each and at least one movable guide element piece disposed between the end segments. The guide element piece is movable between a first and a second position. In the first position it is aligned at both of its ends with one of the guide element sections. In the second position none of its ends are aligned with the same guide element sections. At least two of the end segments comprise an actuating element each displaceable in the longitudinal direction of the guide element section of the respective end segment in a guide between an extended and a retracted position. The extended position is in closer proximity to the free end of the respective end segment than the retracted position. Each of the actuating elements is coupled to the movable guide element piece such that in both end positions of the guide element piece at least one of the actuating elements is in the extended and at least a further one of the actuating elements is in the retracted position. Each of the actuating elements has a nose means for engagement by a vehicle. Each guide comprises a guide section proximate its end corresponding to the retracted position of the respective actuating element. The guide section is inclined with respect to the longitudinal direction of the respective guide element section such that the nose means in the retracted position of the respective actuating element is out of the range of engagement by the vehicle.

DETAILED DESCRIPTION OF THE PREFERRED EMBODIMENTS

Figure 1:
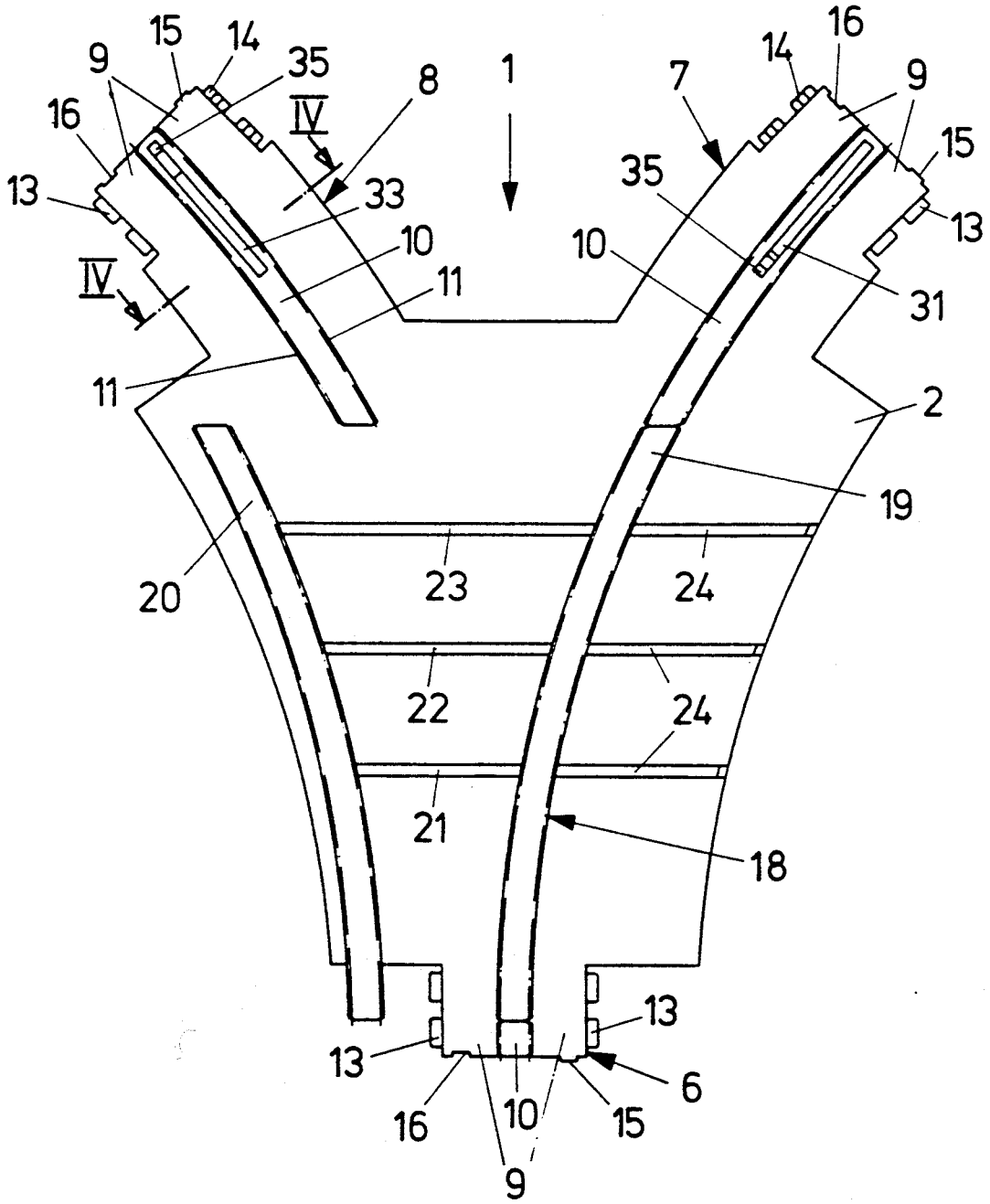
FIG. 1 is a plan view of a track assembly provided with a Y-switch point and with an actuating device in accordance with the present invention, wherein a gear linkage shifting element is displaceably mounted.
Figure 2:
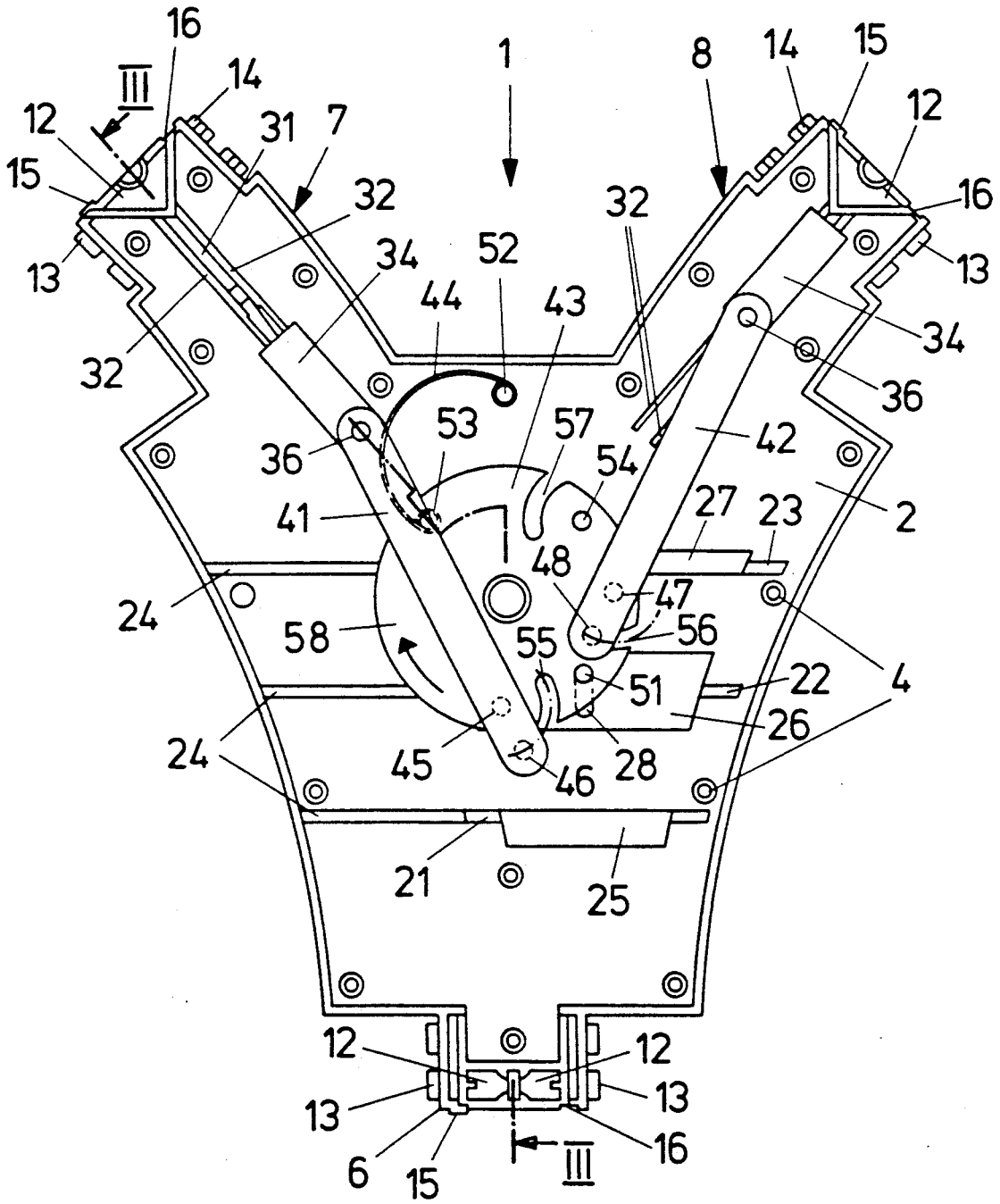
FIG. 2 is a bottom view of the Y-switch point of FIG. 1, with its lower cover removed.

The Y-switch point 1 illustrated in FIGS. 1 to 4 comprises a plate-like upper part 2 and a plate-like bottom cover 3 (FIGS. 3,4) which is removed in FIG. 2 to make the inner parts of the upper part 2 visible. For mounting the bottom cover 3 on the upper part 2, the upper part 2 is provided on its inner side with a plurality of hollow pins 4 (FIGS. 2,3) into which elongated matching pins 5 (FIG. 3) are inserted.

Figure 4:
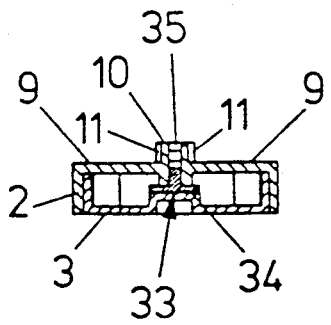
FIG. 4 is a section along line IV—IV of FIG. 1.

As can be seen in particular from the three end segments 6, 7 and 8 as well as from the section of FIG. 4, the present switch point 1 is defined for a toy cog railway, whose track has two smooth track faces 9 and a center gear rack 10. The rack 10 is provided with lateral gear teeth 11 at both sides. The associated vehicles 84 for this track 86 are provided with rimless wheels 89 which roll on the smooth track faces 9 and with sliding guides for guiding the vehicles on the track faces and along the rack 10. A drive vehicle 84 is provided with a gear 87 which engages the teeth 11 on one side of rack 10, 85 and which is driven by a motor. At its front end the vehicle 84 has a protrusion 85 running above the rack 85 in close proximity thereto.

The end segments 6, 7 and 8 of the Y-switch point illustrated in FIGS. 1 and 2 are designed for connection with straight or curved track pieces whose tracks have the same structure, that is, two smooth drive faces 9 and a center rack 10. Moreover, the subject toy cog railway elements are designed to be used in a toy-building system such as that sold under the LEGO trademark which is based on a uniform assembly of structure elements of different types which are connectable by means of coupling pins and corresponding hollow counter coupling elements. Accordingly, the present switch point 1 depicted in FIG. 2 is provided in its end segments 6, 7 and 8 with hollow spaces 12 on the underside thereof which are limited by wall parts on the platelike upper part 2 and which are used to receive in a clamping manner coupling pins of a building plate, support pillars, etc. Lateral coupling pins 13, 14 are provided for connecting the end segments 6, 7 and 8 of switch point 1 with other track pieces as can be seen in FIGS. 1 and 2. Additional track pieces (not shown) are also provided at both sides with pairs of coupling pins. For connecting purposes cover plates (not shown) are provided which may be plugged onto the segment coupling pins 13, 14 of the one side of the corresponding end segment 6, 7, 8 of switch point 1 and any additional track piece. The coupling pins 13 on the outside are cylindrically shaped, while the inner coupling pins 14 have a cross shaped form so as to facilitate their molding. The front faces of the end segments 6, 7, 8 are provided with protrusions 15 and recesses 16 and corresponding recesses or protrusions are provided on the straight or curved track pieces which are to be connected. As a result of the intermeshing of these protrusions and recesses any lateral displacement of the track pieces being coupled to switch point 1 is eliminated. The protrusions 15 and the recesses also form coding elements which assure that only such straight or curved track pieces may be connected with switch point 1 as conform with the grid of coupling pins of the building system.

With respect to the present switch point for tracks which are provided with a center gear rack for a toy cog railway, one faces the same constructive problems as with a real cog railway. Thus, switch points of real cog railways are provided with complicated mechanisms which are separated into a plurality of rail pieces and rack pieces for shifting the travel direction. Although, in the present toy cog railway the constructive problems are less severe in that smooth drive faces are present instead of profiled rails, a shifting mechanism of the type of known customary switching points of actual cog railways having a plurality of pivotable rack pieces would be relatively expensive and subject to breakdowns.

In an existing actual cog railway a simplified switch point construction has been realized in a single case, whose principle is also used in the present switch point. In the cog railway in Switzerland to the Pilatus mountain (Pilatus cog railway) the switch points at by-pass locations are designed in such a manner that for each driving direction a separate track piece with a rail and rack are provided. The two track pieces are desposed adjacent to each other and can be commonly displaced transversely to the longitudinal direction of the track mechanically into two end positions, so that in both end positions one continuous track is provided for the respective routing direction of the switch point.

Figure 7:
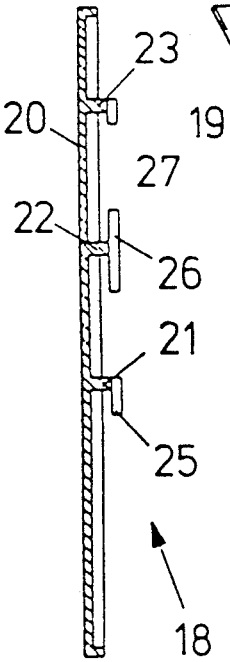
FIG. 7 is a section along line VII—VII in FIG. 6.

The present switch point makes use of this known shifting principle. It can be seen from FIG. 1, 6 and 7 that a shifting device 18 consists of two oppositely curved rack pieces 19 and 20 which are disposed adjacent to each other and are connected with each other by means of three ribs 21, 22 and 23. Ribs 21, 22, 23 are guided in transverse slots 24 of the plate-like upper part 2 (FIGS. 1,2). A lower holding plate 25, 26, 27 (FIGS. 2,6,7) is formed on each rib 21, 22, 23 which engage on the lower side of the upper part 2, see also FIG. 3. The center and wider holding plate 26 is also provided with a longitudinal hole 28 (FIG. 6), whose function will be explained later. Accordingly, the shifting device 18 may be brought into two end positions by a lateral displacement, whereby in the one end position illustrated in FIG. 1, the end segment 6 is connected at the front face in an engaging manner with the fixed rack piece 10 of end segment 7 by means of the movable rack piece 19 of the shifting device 18. In the other end position, not illustrated in FIG. 1, which is effected by displacement of the shifting device 18 to the right in FIG. 1, the fixed rack piece 10 of end segment 6 is connected with the fixed rack piece 10 of end segment 8 by means of the movable rack piece 20. A simultaneous displacement of the track rails as is the case in the previously mentioned Pilatus cog railway, is not required in this case since in the present exemplified embodiment of a toy cog railway the track has smooth and not profiled track faces.

In the Pilatus cog railway the displacement of the two curved rail segments, which are each provided with one rack, is performed by a manually actuated gear.

In the present invention the selection of the driving direction to one of the two branches of the switch point (that is, the selection of the branch) is performed manually, but the selection of the correct track as the train travels onto the switch point from a branch is performed exclusively mechanically and automatically by the vehicle.

Reference is now made to FIGS. 1–7. As can be seen from FIGS. 1, 2 and 3 a longitudinal slot 31 is formed in the two end segments 7 and 8 of the Y-switch point 1 in rack 10 and in the bottom of upper part 2. For a better understanding the actuating device according to the present invention will be explained at first only in conjunction with end segment 7. The longitudinal slot 31, as can be seen from FIG. 2, is limited on the lower side of the upper part 2 by lateral guiding bars 32. The longitudinal slot 31 is covered by the lower cover 3 of switch point 1 (as can be seen from FIG. 3). A tongue-like actuating element 33 is inserted in the longitudinal slot 31 from which a longitudinal plate 34 extends. The tongue-like actuating element 33 is provided with a nose 35 (FIG. 3) which is disposed in the uppermost area of the longitudinal slot 31. The plate 34 is provided at its protruding end with two pins 36, whose purpose will be explained later. Actuating element 33 can be seen in a sectional view in FIG. 4, as well as in a plan view and a side view in FIGS. 5A and 5B.

The actuating element 33 is guided laterally in the longitudinal slot 31 as well as between the guiding bars 32. The height of actuating element 33 with respect to the track face 9 or the upper face of rack 10 depends on its longitudinal position in the longitudinal slot 31. As can be seen from FIG. 3, the part of the actuating element 33 which is disposed opposite to nose 35 is supported on the inner face of the bottom cover 3.

The bottom cover 3 has in the end segment 7 a first outer area 37 which is in closer proximity to the upper part 2 than a second inner area 38. When the actuating element 33 rests on the inner area 38 it is disposed so deeply in the longitudinal slot 31 that its nose 35 extends only to the level of the upper face of the rack 10, as can be seen from FIGS. 3 and 4. When the actuating element 33 is displaced in the longitudinal slot 31 to the end of the end segment 7, the part which is disposed opposite nose 35 moves along a ramp like segment 39 of the lower cover 3 to the outer area 37 of the lower cover 3. Thus, during such longitudinal movement the actuating element 33 is lifted, so that when it is at the outer end of the longitudinal slot 31 the nose 35 protrudes beyond the rack 10. Accordingly, the actuating element 33 has two different height positions within longitudinal slot 31, wherein its nose 35 is either within the longitudinal slot 31 or protrudes out of the longitudinal slot 31 and beyond the upper face of rack 10.

The other end segment 8 of switch point 1 is the same as end segment 7 with respect to the longitudinal slot 31, the actuating element 33 inserted therein and the shape of the lower cover 3. As can be seen from FIGS. 1 and 2, the actuating element 33 is positioned in end segment 8 in its front or outer position, wherein its nose 35 protrudes beyond the upper face of rack 10.

The two actuating elements 33 of the end segments 7 or 8 are mechanically coupled with the aforementioned shifting device 18 for shifting and reverse shifting. These two effects, shifting and reversing are performed simultaneously by coupling members in a simple manner. Since these coupling members are provided on the lower face of upper part 2 reference is made to FIG. 2 as well as FIG. 3.

The coupling members comprise, as shown in FIG. 2, two levers 41 and 42, a rotating element 43 in form of a rotatably mounted disk as well as a pretensioned spring 44 for the rotating element 43.

Figure 3:
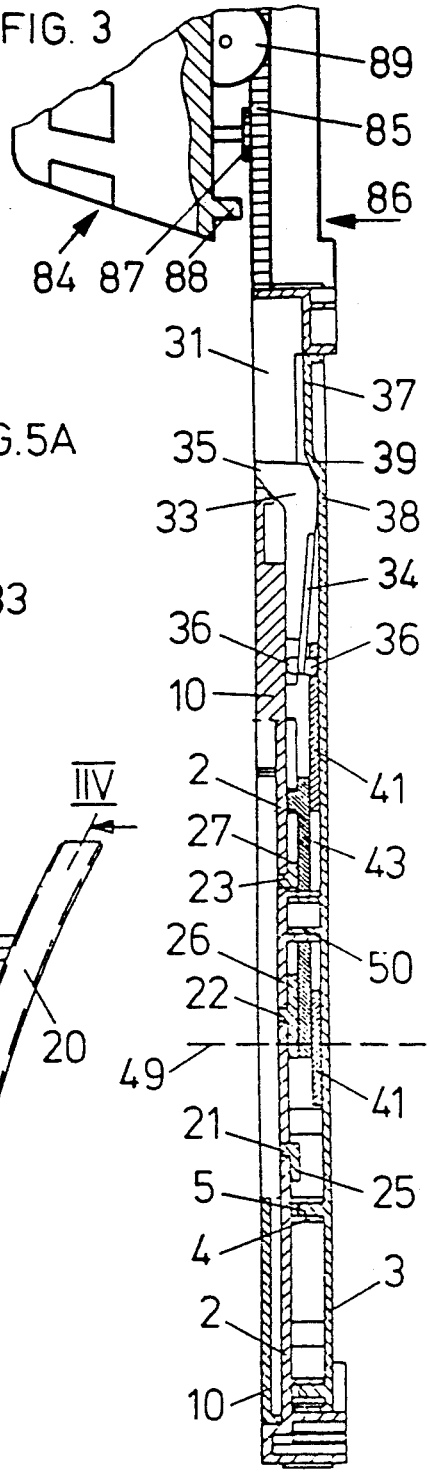
FIG. 3 is a section along line III—III of FIG. 2.
Figure 6:
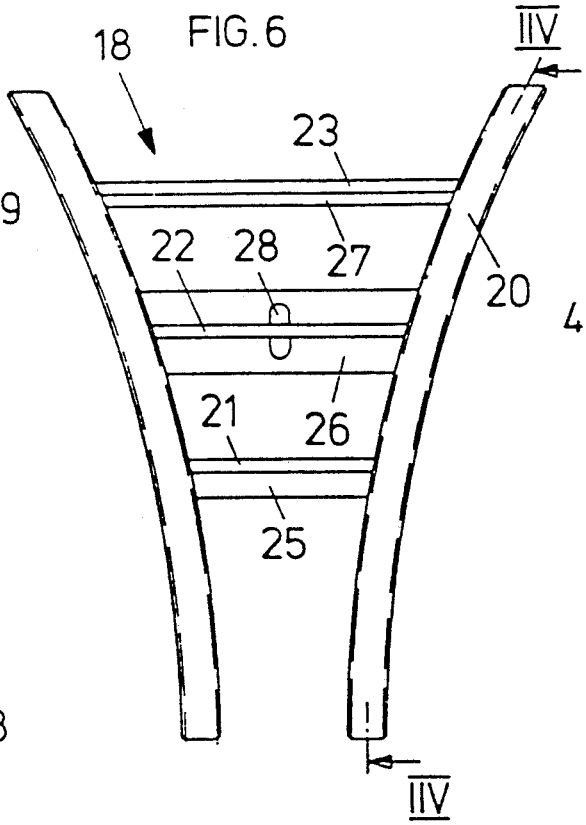
FIG. 6 is a plan view of the gear linkage-shifting element of the Y-switch point of FIG. 1 and 2.

The two levers 41 and 42 are identically shaped and are pivotably mounted on a pin 36 of the one or the other actuating element 33 by means of a corresponding hole. The other pin 36 of the actuating elements 33 is used, as can be seen from FIG. 3, for supporting the actuating element 33 on the protruding end of its plate 34 on the lower face of upper part 2. Each lever 41, 42 is provided with two pins 45, 46 or 47, 48 at its other end. Of these pins only the inner pin 45 or 47 is used in both levers 41, 42 in that it is plugged into a corresponding hole in the rotating element 43. The pin 45 and the corresponding hole of the rotating element 43 are indicated in FIG. 3 by a dash-dotted line 49. The rotating element 43 is rotatably mounted on a hollow pin 50 of the bottom cover 3 (FIG. 3). Moreover, the rotating element 43 is provided with a pin 51 which engages into the longitudinal hole 28 of holding plate 26 of the shifting device 18 (FIGS. 2 and 6). Finally, the rotating element 43 is subjected to the force of the curved wire spring 44 which is mounted with end eyelets on a fixed pin 52 of the lower face of the upper part 2, on the one hand, and on a pin 53 of the rotating element 43, on the other hand. Spring 44 urges the rotating element 43 into its one illustrated end position as well as into another end position which will be described later.

A further hole 54 of the rotating element as well as the outer pins 46 or 48 of levers 41 and 42 serve no function in this embodiment but are provided to enable the same levers to also be used in different embodiments. To prevent the unused pins 46, 48, during a rotating movement of the rotating element, from interfering with the same, the rotating element 43 is provided with corresponding curved slots 55 and 56. A further curved slot 57 is of no interest in the embodiment of FIG. 1–7.

The mode of operation of the Y-switch point, illustrated in FIG. 1 and 2, when being travelled on by a vehicle is as follows, whereby it is to be assumed that the vehicle is provided, at least at its front sides, with a protrusion, for example, a cam, a bar or the like. This protrusion should be disposed, when the vehicle travels on the track, with its lower edge above the upper face of rack 10 and should extend over the width of the rack 10.

When a vehicle travels onto the switch point 1 as illustrated in FIG. 1 from the end segment 7 this is without any problems since the correctly positioned rack piece 19 permits the unobstructed passage of the vehicle. Switch point shifting is unnecessary or undesirable and this is assured by the nose 35 of the actuating element 33 not protruding beyond the upper part of rack 10 in end segment 7. As a result the nose 35 cannot come into engagement with the protrusion of the vehicle.

However, if a vehicle travels onto the switch point 1 as illustrated in FIG. 1 from end segment 8, the aforementioned protrusion of the vehicle abuts against nose 35 of the actuating element 33 which protrudes in the end segment 8, the aforementioned actuating element 33 is pushed inwards in the longitudinal direction in longitudinal slot 31 during the further travelling of the vehicle until it is lowered so deep into the inner area 38 of cover 3 that its nose no longer protrudes.

In view of this longitudinal displacement of the actuating element 33 in end segment 8, being caused by the vehicle, the following happens (See FIG. 2):

Through lever 42 a force with a tangential component is exerted on the rotating element 43 in view of the displacing of the actuating element 33, so that the rotating element 43 rotates as indicated by arrow 58 against the force of spring 44. During this rotating movement pin 51 of rotating element 43 displaces the holder plate 26 of the shifting device 18 to the left in FIG. 2 or to the right in FIG. 1, so that the curved rack piece 20 is brought into alignment with the racks 10 of end segments 6 and 8. Simultaneously the rotating element 43 displaces the actuating element 33 of end segment 7 in the longitudinal direction outwardly, so that its nose protrudes above the upper face of rack 10 in end segment 7. During the rotation of the rotating element 43 its spring 44 is pushed beyond a dead center, whereupon spring 44 pushes the rotating element 43 into this other end position. Thus, it is assured that the curved gear rod pieces 19 and 20 assume their precise position for an unobstructed passage, and that the actuating elements 33 in the longitudinal slots 31 are also retained in their respective end positions.

The described shifting of the curved rack pieces 19 and 20 is performed by the rotating movement of the rotating element 43 so rapidly that in the described case the rack piece 20 is in its correct position long before it is reached by the vehicle from end segment 8.

A revers shifting of switch point 1 into the previous base position is performed in the same manner when the vehicle travels into the end segment 7.

A preselection of the switch point 1 for the passage of a vehicle from end segment 6 can be performed in any given manner. In the simplest case the shifting to the desired position is performed by a manual lateral displacement of the shifting device 18 (displacing the rack pieces 19 and 20). However, other shifting means are feasible, for example, switch point levers and the like.

The described actuating device and the described shifting device enable an automatic and problemless obtuse travelling of the switch point, for which only a few and simple mechanical parts are required.

In conjunction with FIG. 8 and 9 a further embodiment of the actuating device in a switch point according to the invention is briefly described in the following. As can be seen, FIG. 8 relates to a right hand switch point 61 which deviates from the Y-switch point of FIG. 1 in that it contains a curved rack piece 62 and a straight rack piece 63 which both are again parts of a shifting device 64. The shifting device 64 and an upper part 65 are designed similar to the previously described Y-switch point 1. Moreover, in the curved end segment 66 and in the straight end segment 67 similar actuating elements 33 with noses 35 are provided in longitudinal slots 31 of the corresponding rack pieces, so that a further explanation is not required.

Figure 9:
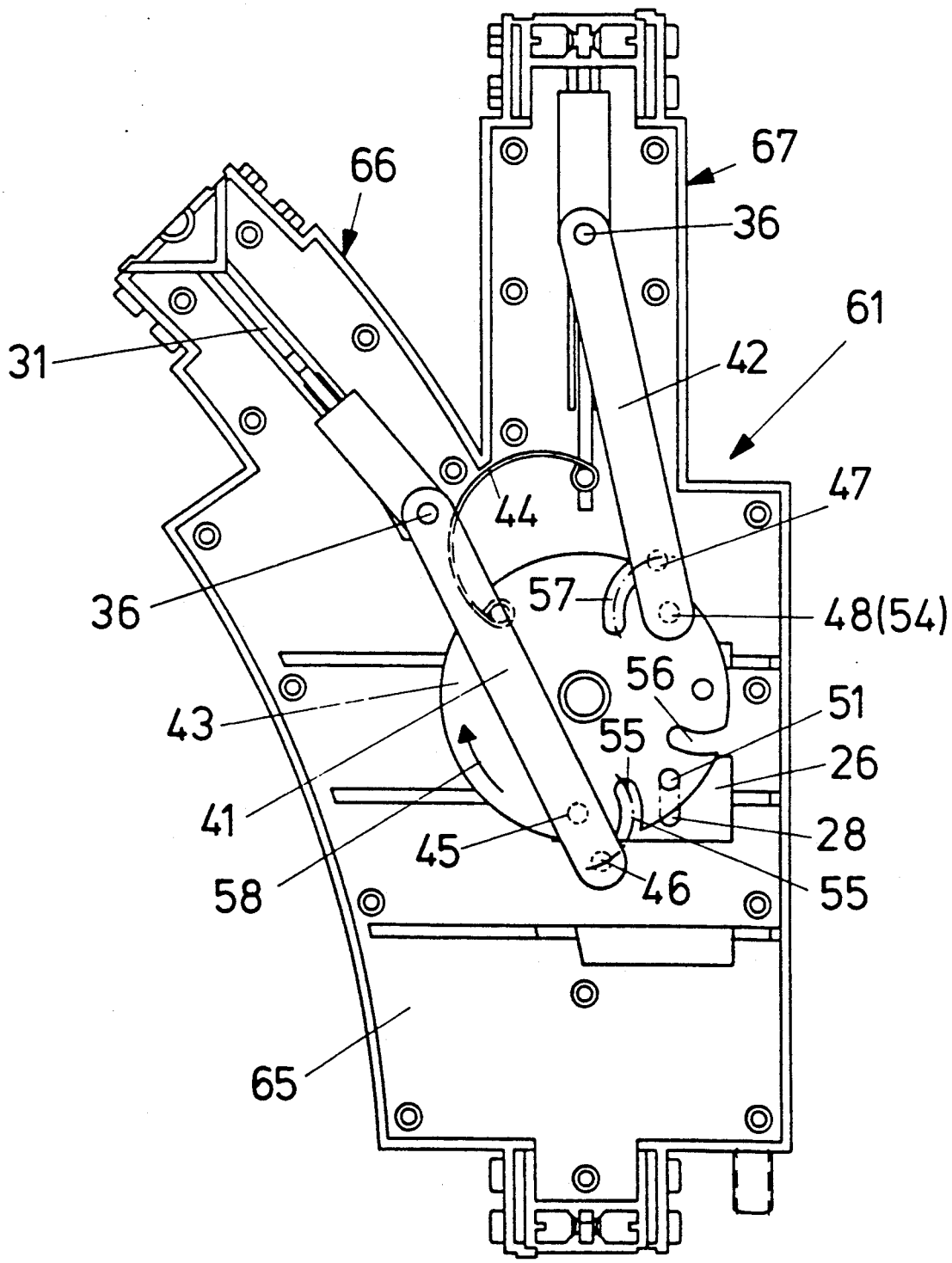
FIG. 9 is a bottom view of the right hand switch point of FIG. 8 with its lower cover removed.

As can be seen from FIG. 9, the coupling members are shaped in the same manner as in the switch point 1 in accordance with FIG. 2. Therefore, the same levers 41, 42 and the same rotating element 43 is present which is pretensioned by the same spring 44. The only difference with respect to FIG. 2 is the connection of the one lever with the rotating element.

Since the curved end segment 66 in its dimensions and in its direction coincides with the end segment 7 of FIG. 1 and 2, lever 41 is connected in the same manner with the rotating element 43, namely through its inner pin 45. However, the actuating element 33 of the straight segment 67 with respect to the rotating element 43 is disposed at a different angle and is at a different distance than the one of the second end segment 8 of FIG. 2. Thus, the outer pin 56 of lever 42 is plugged into the hole 54 of the rotating element 43 (see also FIG. 2). The coupling of the rotating element 43 with the shifting device 64 is again performed by pin 51 of rotating element 43 which engages into the longitudinal hole 28 of holder plate 26 of shifting device 64.

The mode of operation of switch point 61 is the same as the described mode of operation of switch point 1. Also a left handed switch point would be constructed in the same manner but reversed whereby for the levers 41 and 42 different coupling locations would be present on rotating element 43, but the same levers and the same rotating element could be used.

Figure 10:
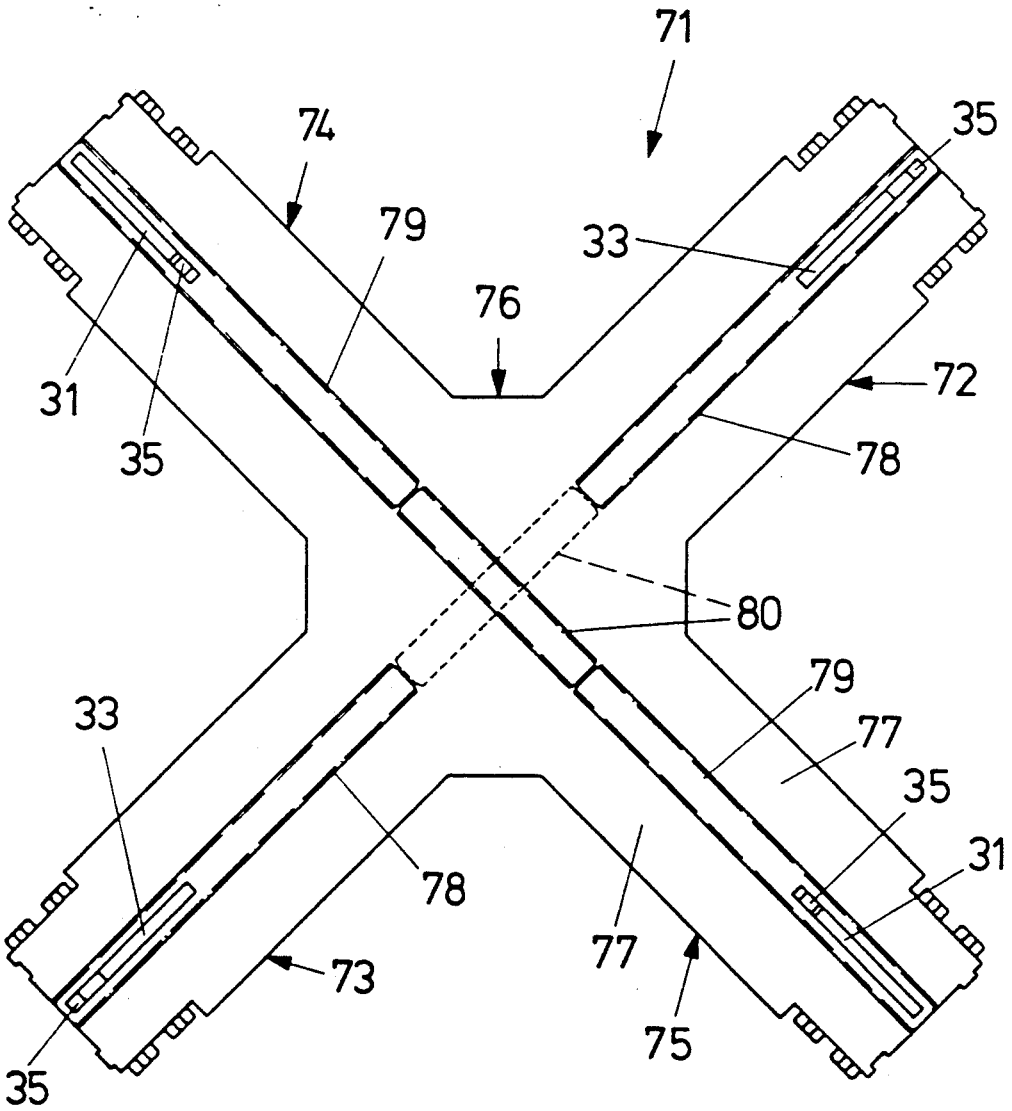
FIG. 10 is a plan view of a track assembly designed as a 90°-crossing and provided with an actuating device in accordance with the present invention.
Figure 11:
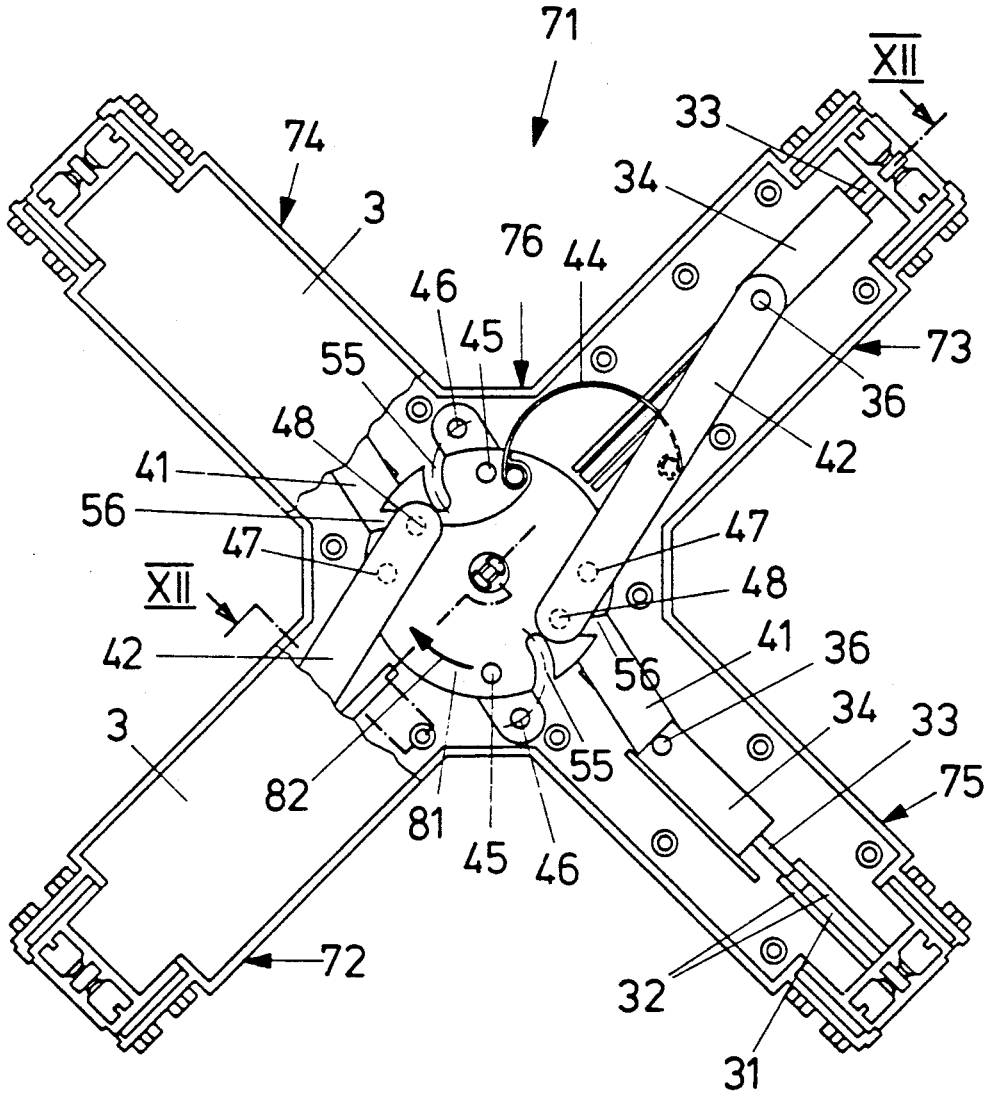
FIG. 11 is a bottom view of the 90°-crossing of FIG. 10 with partially cut open lower cover.
Figure 12:
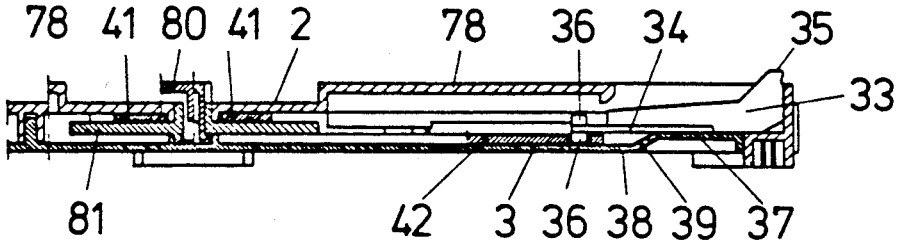
FIG. 12 is a section along line XII—XII in FIG. 11.

The embodiment of the actuating device depicted in FIGS. 10–12 is designed for a 90°-crossing of a cog railway track assembly.

As can be seen from FIG. 10, the crossing 71 comprises four end segments 72, 73, 74 and 75 as well as a center part 76 connecting these end segments. The end segments 72 to 75 and the center part 76 form two continuous smooth track faces 77 for a vehicle provided with smooth wheels as previously discussed. The track faces 77 of the end segments 72, 73, 74, 75 are separated by a straight rack piece 78 or 79 which are fixedly connected with the track faces 77. In the center part 76 a shorter straight rack piece 80 is rotatably mounted in the track faces 77 in order to enable the passage of the vehicle between the end segments 74 and 76 (in the position of the rack piece 80 illustrated) or between the end segments 72 and 73 of the 90° position of the rack piece 80 (as illustrated with dash dotted lines).

For an automatic shifting of the position of the rack piece 80 by means of the vehicle which travels crossing 77, an actuating device is provided which is modified from the embodiments previously discussed.

Accordingly, each end segment 72 to 75 is provided with a tongue shaped actuating element 33 slidably mounted in a longitudinal slot 31 of the corresponding rack piece 78 or 79. Each tongue is provided with an upwardly directed nose 35, as already illustrated in FIGS. 1 and 8. The actuating elements 33 of the two end segments 72 and 73 are in an outwardly displaced position, where a shifting of the center rack piece 80 by 90° is required for enabling the passage, the noses 35 protruding beyond the surface of the corresponding rack pieces 78. In contrast thereto, the actuating elements for the end segments 74 and 75, for which the center rack piece 80 is already in a passage permitting position, are in their inwardly displaced position, where the noses 35 are lowered to the level of the upper face of the corresponding rack pieces 79.

During the travelling of a vehicle onto the end segments 72 or 73 the vehicle displaces the respective actuating element 33 by the nose 35 inwardly, whereby at the inner end of this displacement movement the position of the nose 35 is no more than at the level of the upper face of rack piece 78. By means of a mechanism, which will be described in the following, the center rack piece 80 is rotated by 90°, so that the vehicle can travel the crossing 71 without any obstruction. By means of this mechanism the actuating element 33 of the other end segments 74 and 75 are simultaneously displaced outwardly, so that their noses 35 protrude beyond the corresponding rack pieces 79.

The mentioned mechanism is illustrated in FIGS. 11 and 12 and basically corresponds to the actuating devices of the Y-switch point 1 or the right hand switch point 61 described in conjunction with FIGS. 2 and 9. Therefore identical parts in FIGS. 11 and 12 are designated with the same reference numerals. The principle is based on the displacement movement by the vehicle to one of the four actuating elements, whereby this movement is transmitted to the remaining three actuating elements in the desired manner by means of pivotably mounted levers and a central spring-urged rotating element. Each actuating element 33 is guided in the aforementioned described manner laterally by guiding bars 32 of the longitudinal slot 31 and on the lower side by the cover 3 by means of a longitudinal plate 34 which extends from actuating element 33. The cover 3 is provided in the area of the longitudinal slot 31 with an outer area 37 and a deeper inner area 38, whereby these two areas 37, 38 are connected with each other by means of a ramp like segment 39 of cover 3. Therefore, within the inner area 38 the actuating element 33 is located deeper than in the outer area 37. On its protruding end the longitudinal plate 34 is again provided with two pins 36.

A lever 41 is pivotably mounted on each actuating element 37 of end segments 74 and 75 and a lever 42 is mounted on the end segments 72 and 73. The upper pins 36 are plugged into corresponding holes in the levers 41 and the levers 42 are plugged into the lower pins 36 of the longitudinal plate of actuating elements 33, as can be seen from FIG. 11 and with respect to the one lever 42 from FIG. 12.

A disk like rotating element 81 is centrally mounted in the center part 76 between the upper part 2 and the lower cover 3 in a rotatable manner. On the upper face of the rotating element 81 the central rack piece 80 extends. The rotating element 81 is also subjected to the force of a pretensioned spring 44 as previously described.

Each lever 41, 42 is provided at its other end, in accordance with FIG. 2 and 9, with two pins 45 and 46 or 47 and 48 (only partially indicated in FIG. 11), of which the inner pins 45 or 47 are plugged into corresponding holes of the disk like rotating element 81. The levers 41 are located on the upper face of the rotating element and the levers 42 on the lower face thereof. The outer pins 46 and 48 of levers 41 or 42 are not used in this case but are provided to render the levers univeral for the various embodiments. In order not to obstruct the rotation of the rotating element 81 by the outer pins 46 and 48, the rotating element 81 is provided with corresponding curved slots 55 and 56 for receiving the outer pins 46 or 48 of levers 41 or 42.

When a vehicle travels onto the end segment 72 or 73 and thereby displaces the corresponding actuating element 33 inwardly, a rotation of the rotating element 81 in the direction of arrow 82 is caused by means of the associated lever 42. This rotating movement simultaneously actuates the other lever 42 and the two levers 41. Thereby, the actuating element 33 of end segments 73 or 72 is displaced inwardly and downwardly by lowering its nose 35 over the ramp like segment 39 of lower cover 3 (FIG. 12), while the actuating elements 33 of the other end segments 74 and 75 are simultaneously moved outwardly and their noses 35 lifted up. The end positions are retained by the pretensioned spring 44, which during the rotation of element 81 moves over a dead center.

The described actuating device may also be used in a crossing having a crossing angle other than 90°, whereby only a disk like rotating element with differently arranged holes would have to be provided for the pins of levers 41 and 42. It was previously mentioned that a shifting of the switch point for travelling towards one or the other branch, in the simplest case, may be performed manually by means of a lateral displacement of the shifting device. However, with the actuation device in accordance with the present invention an embodiment of a switch point may be realized, wherein the selection of the driving direction of the switch point is preselectable by means of switch point levers which are actuated either manually or by remote control, and wherein the described automatic shifting of the switch point into the correct position by the vehicle travelling onto a branch remains. In conjunction with FIGS. 13 to 15 one exemplified embodiment of such a right hand switch point depicted with a preselection means will be described in the following.

Figure 8:
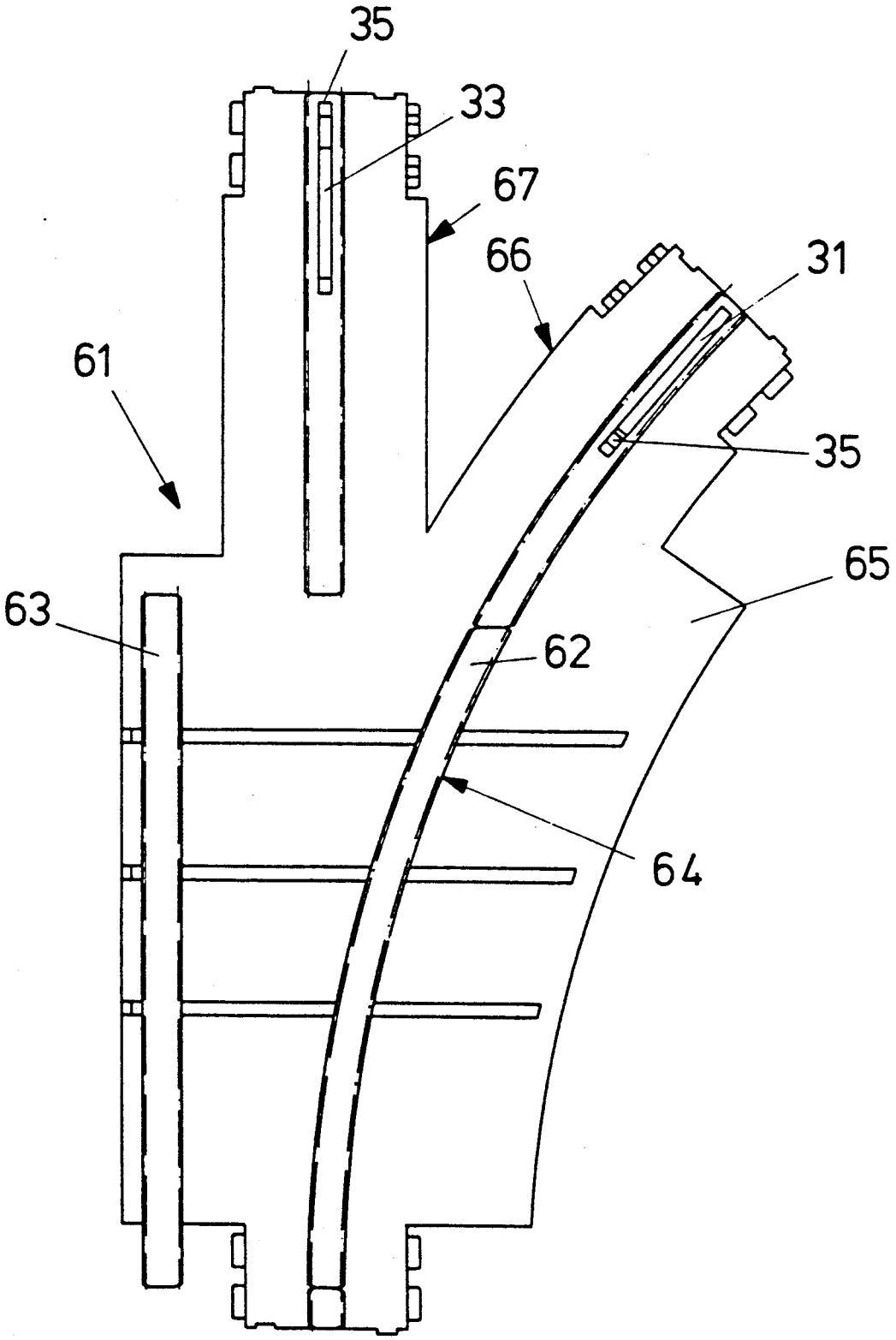
FIG. 8 is a plan view of a track assembly designed as a right hand switch point and provided with the actuating device in accordance with the present invention, wherein a gear linkageshifting element is displaceably disposed.
Figure 13:
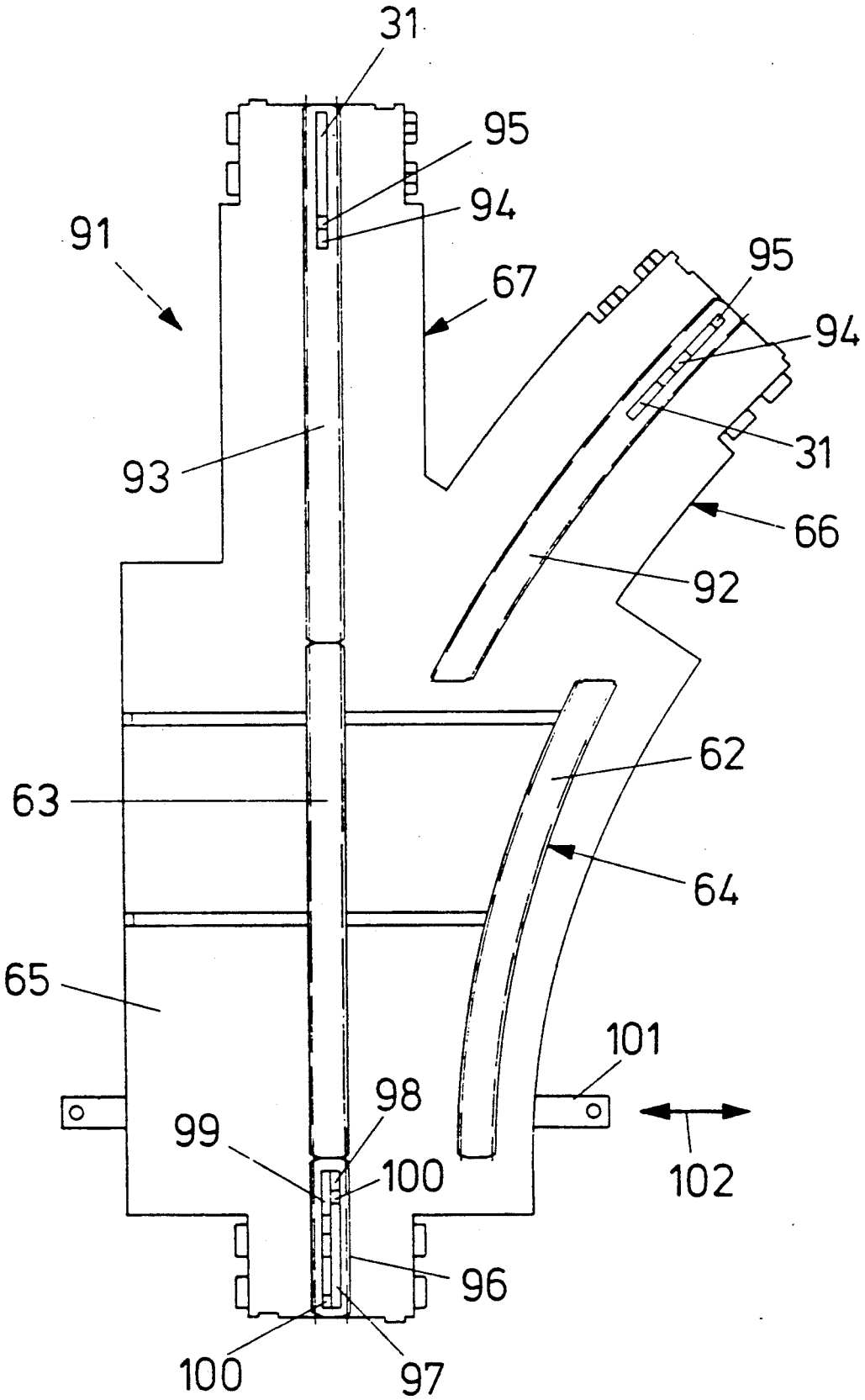
FIG. 13 is a plan view of a track assembly designed as a right hand switch point and provided with an actuating device in accordance with the present invention which has a preselection device for selecting the drive direction to one of the two switch point branches during travelling past the switch point.

In the plan view of FIG. 13 a right hand switch point 91 has substantially the same structure as the right hand switch point 61 previously described in conjunction with FIG. 8. Accordingly, the switch point again contains a curved rack piece 62 and a straight rack piece 63, whereby both rack pieces are parts of a laterally displaceable shifting device 64. In a curved end segment 66 and in a straight end segment 67 of an upper part 65 stationary rack pieces 92 or 93 are provided which are also provided with the aforementioned longitudinal slots, wherein tongue-like actuating elements 94 are mounted displaceable in the longitudinal direction. The actuating elements 94 are provided with protruding noses 95. When the actuating element 94 is moved outwardly in the end segment 66 its nose 95 protrudes beyond the surface of the corresponding curved rack piece 92, while the nose 95 of the actuating element 94 which is displaced inwardly is lowered to at least the level of the surface of the corresponding straight rack piece 93.

The difference with respect to the switch point 61 of FIG. 8 is that the straight rack piece 96 extending in front of the branch ends is also provided with a longitudinal slot 97, wherein two similar adjacent tongue like actuating elements 98 and 99 with associated noses 100 are displaceably mounted. The actuating elements 98 and 99 also have two end positions within the longitudinal slot 97, namely an inner and an outer end position which are alternatingly assumed by the actuating elements 98, 99. Each actuating element 98, 99 is lowered to such an extent in the inner end position in longitudinal slot 97 that its nose 100 does not protrude beyond the upper face of rack piece 96. In its outer end position each actuating element 98, 99 either protrudes with its nose 100 above the upper face of the rack piece 96, or it is also lowered in the longitudinal slot 97 as in its inner end position. For determining or preselecting the height position of the nose 100 of each of the actuating elements 98, 99 with respect to the upper face of the rack piece 96 for the outer end position a switch point lever 101 is provided which is displaceable in lateral direction in accordance with the double arrow 102 and which can be mechanically brought into engagement with the actuating elements 98, 99.

Figure 14:
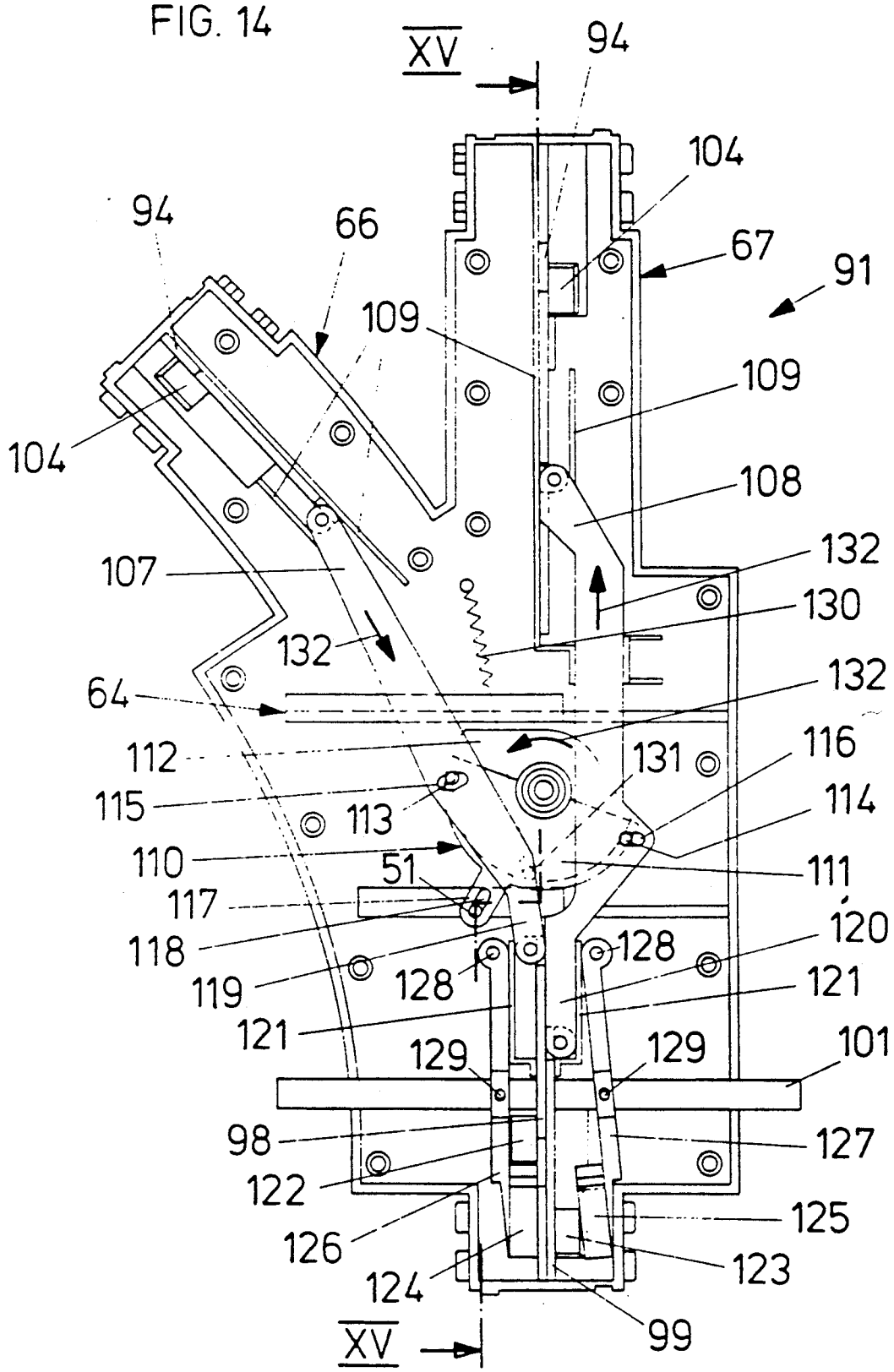
FIG. 14 is a bottom view of the right hand switch point of FIG. 13 with its lower cover removed.
Figure 15:
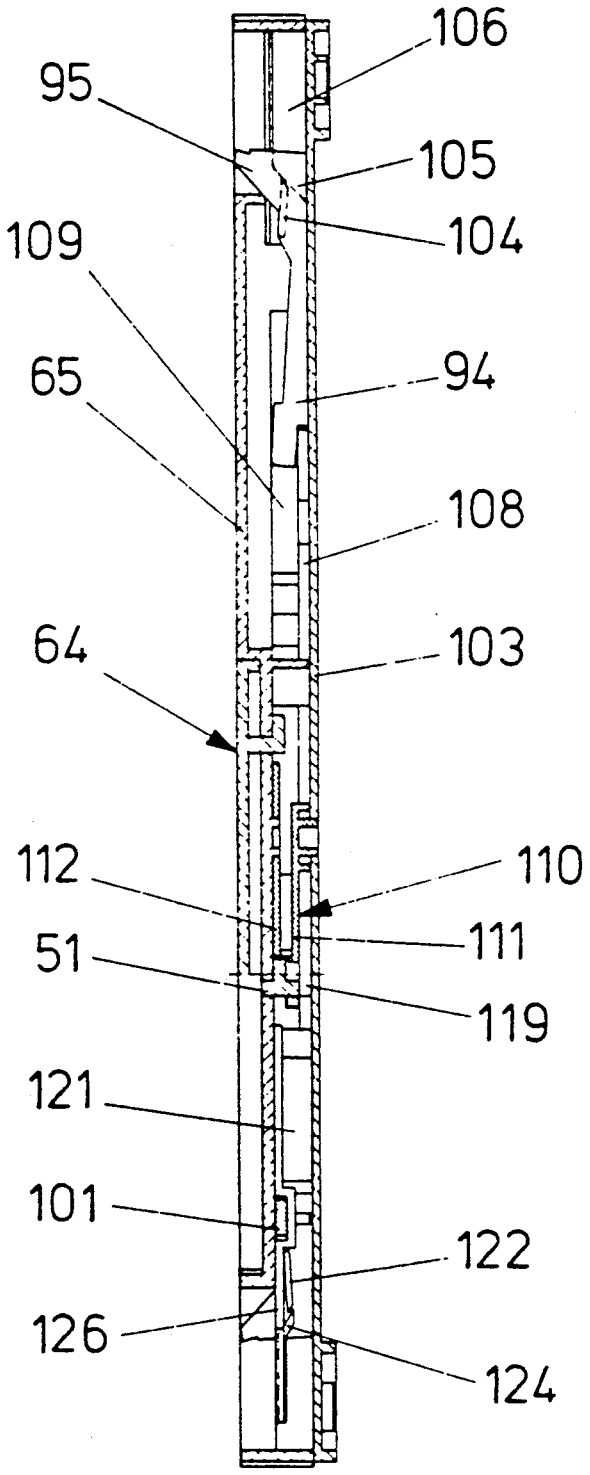
FIG. 15 is a section along line XV—XV in FIG. 14.

Reference is now made to FIGS. 14 and 15 wherein actuating element 94 of the two end segments 66 and 67 is provided with a lateral shoulder 104 which slides along a guiding piece 106 with associated ramp 105 during the longitudinal displacement of the actuating element 94. Thus, the nose 95 of the actuating element extends only to the level of the upper face of the corresponding rack piece 93 (end segment 67) in its inwardly displaced position. In the outwardly displaced position it extends above the upper face of the rack piece 92 (end segment 66). Each actuating element 94 is pivoted on a lever 107 or 108, whose further connections will be explained in the following. A plurality of lateral guiding walls 109 are formed for a longitudinal guiding of the actuating elements 94 and their pivot locations on levers 107 or 108.

As can be seen from FIGS. 14 and 15 a disk 110 is rotatably mounted between the lower cover 103 and the upper part 65. The disk 110 is shaped in form of a laterally partially opened can and is provided with a lower wall 111 and an upper wall 112. The lower wall 111 is provided with two pins 113 and 114 which are plugged into corresponding openings 115 or 116 of the levers 107 and 108. The upper wall 112 is provided with a flap 117 which has a longitudinal hole 118 into which the pin 51 of the shifting device 64 engages, as previously explained in conjunction with FIG. 9.

The levers 107 and 108 are provided beyond their pivot locations at the rotatable disk 110 with extended lever arms 119 and 120, at the ends of which the further actuating elements 98 and 99 are pivoted. Lateral guiding walls 121 are formed on upper part 65 for longitudinal guiding of the extended lever arms 107, 108.

Each actuating element 98, 99 is provided with a lateral horizontal shoulder 122 or 123 which is used as a support, so as to controllably lift the actuating element 98, 99 in its outer position. Ramps 124 and 125 are formed in levers 126 or 127 which are each mounted to pin 128 and which are connected by pivots 129 with the switch point lever 101. Depending on the lateral position of the switch point lever 101 the ramp 124 or 125 is positioned in the displacement area of the associated actuating element 98 or 99. As illustrated in FIG. 14 for ramp 124, the corresponding actuating element, i.e., the actuating element 98 is lifted upwardly beyond the upper face of the rack piece 96 (FIG. 13) when the actuating element 98 is moved outwardly by a turning of disk 110.

In order to retain the disk 110 in its two rotating end positions, a tension spring 130 is provided which is anchored on the upper part 65 and mounted on the walls 111, 112 of the disk 110 by means of a pin 131. It can be seen that the spring 130 can move without any obstructions in the hollow space between the two walls 111, 112 of disk 110 and can therefore move over a dead center during a rotation of the disk 110.

The mode of operation of the right hand switch point 91 illustrated in FIGS. 13 through 15 is as follows:

When the vehicle travels onto one of end segments 66 and 67 a shifting of the shifting device 64 is performed, if need be, i.e., the rack pieces 62 and 63 are shifted in the same manner as has been already described for the right hand switch point in conjunction with FIG. 8 and 9. During the travelling of the vehicle onto the end segment 67 of FIGS. 13 and 14 no shifting occurs, because the corresponding actuating element 94 is in its lowered position and because the straight rack piece 63 is in the position for straight passage.

The two further actuating elements 98 and 99 which are present at the acute end of the switch point 91 are both lowered, so that during the passage of the vehicle from the direction of the end segment 67 no contact of these actuating elements are made by the vehicle. If the one actuating element 99, which is in its outer position, would be lifted by the associated ramp 125 of lever 127 in accordance with the corresponding position of the switch point lever 101, an unobstructed passage of the vehicle would also be assured in this case, because due to its slanted rear edge the actuating element 99 would be pushed yieldingly downwardy by the vehicle.

During the travelling of the vehicle onto the end segment 66 the vehicle pushes the actuating element 94 inwardly. Thereby, the disk 110 is turned by means of the lever 107 and simultaneously the actuating element 94 of the other end segment 67 is pushed outwardly be means of lever 108, which is indicated in FIG. 14 by arrows 132. The shifting device 64 is shifted together with the rotating of disk 110 by means of flap 117 and pin 51, so that the curved rack piece 62 (FIG. 13) is brought into a position which permits an unobstructed passage of the vehicle.

Together with the rotation of disk 110 into its other end position there is also a displacement of the actuating elements 98 and 99, whereby in accordance with FIG. 14 the actuating element 98 is pushed outwardly and the actuating element 99 is pulled inwardly. Thereby, the inwardly pulled actuating element 99 is lowered, so that it is not contacted by the passing vehicle. Depending on the position of the switch point lever 101 the other actuating element 98 remains in the lowered position or is lifted, as is the case in the illustrated position of the switch point lever 101 of FIG. 14. However, in the latter case the actuating element 98 moves elastically away in a downward direction when the vehicle passes, so that no further reaction is generated.

During travelling on the illustrated switch point 91, in the opposite direction the routing depends from the position of the switch point lever 101.

When the actuating elements 98, 99 and the switch point lever 101 are in the position illustrated in FIG. 14, none of the actuating elements 98, 99 are lifted, so that a passage of the vehicle in the present direction, i.e., in a straight direction, occurs to end segment 67. However, if the switch point lever 101 is in its other position, wherein the actuating element 99 is pushed upwardly by the ramp 125 the vehicle arriving at the acute end of the switch point displaces the actuating element 99 inwardly, whereby the disk 110 is rotated into its other end position in the direction of arrow 132 which causes a shifting of the shifting device 64 and consequently the switching of the curved rack piece 62. Thus the vehicle travels towards the deflected end segment 66. The same holds true for the other case, wherein the switch point 91 is in the condition for unobstructed travelling over the end segment 66. Therefore, the routing can be preselected for the traverse of the switch point from its acute end by the adjustable position of the switch point lever 101.

The described preselection device can also be provided for a left hand switch point or a Y-switch point with corresponding levers and a corresponding disk.

In the hitherto described embodiments of switch points in accordance with FIGS. 1, 2; 8, 9; and 13, 14; shifting devices for two different rack pieces were used, wherein the rack pieces are displaceable laterally with respect to the longitudinal direction of the switching point.

However, other embodiments of shifting devices are possible. In the previously mentioned Pilatus cog railway there is a type of a switching point which has superimposed different rack pieces, whose support is rotatable around an axis extending in longitudinal direction of the switch point, so as to bring the one or the other rack piece into the track together with their associated rail segments. However, for a toy-cog railway such a type of switch point is disadvantageous, since for turning the inactive rack piece beneath the switch point a relatively large space must be available.

In contrast thereto it is possible to design the shifting device in such a manner that the rack pieces to be shifted are not laterally displaced, but can be pivoted around a common rotating point at the level of the track. A right hand switch point of this type is described in the following with respect to FIGS. 16 and 17.

Figure 16:
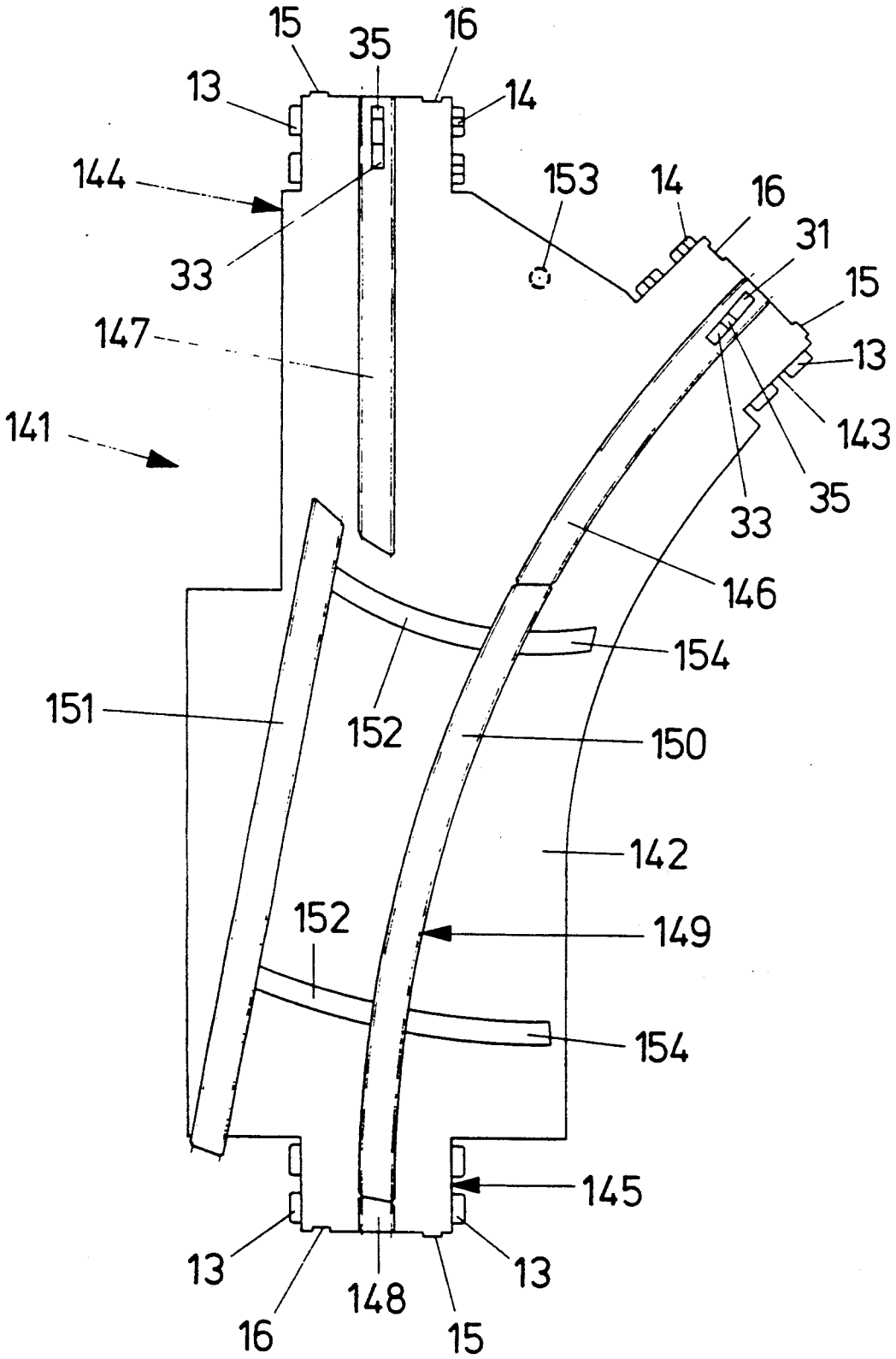
FIG. 16 is a plan view of a track assembly designed as a right hand switch point and provided with the actuating device in accordance with the invention, wherein a gear linkageshifting element is pivotably mounted.

As can be seen from FIG. 16 the subject right hand switch point 141 is provided with an upper part 142 which in its outer shape corresponds to the upper part 65 of right hand switch point 61 of FIG. 8. The upper part 142 contains in one of its two branches a curved end segment 143 and in the other branch a straight end segemnt 144. The stem of the switch point comprises a straight shorter end segment 145. The end segments 143, 144 and 145 are provided with a stationary curved rack piece 146 or with stationary straight rack pieces 147, 148. Between these stationary rack pieces the switch point 141 is provided with a shifting device 149 which contains on the upper part 142 a curved rack piece 150 and a straight rack piece 151. The two rack pieces 150, 151 are fixedly connected with each other by two ribs 152, whereby the rack pieces 150, 151 and the connecting ribs 152 are preferably formed as a single plastic molded part.

As will be explained in the following the shifting device 149 which contains the rack pieces 150, 151 and the connecting ribs 152 is pivotable around a pivot 153. A part of each connecting rib 152 is guided in a respective curved slot 154 of the upper part 142. It can be seen that by pivoting the shifting device 149 around the pivot 153 the one or the other rack piece 150 or 151 can be brought into such a positon which enables travelling over the switch point 141 in the deflected or in the straight direction. In order to assure an unobstucted travelling over the switch point in one of these directions, the stationary and the movable rack pieces 146, 147, 148 or 150, 151 must align with each other in a so-called seamless manner, for this reason their front faces are bevelled, as illustrated in FIG. 16.

Figure 5B:
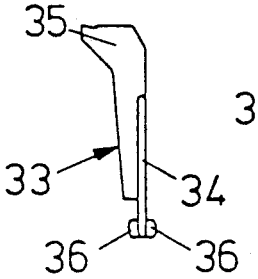
FIGS. 5A and 5B are plan views or side views of an actuating element, of FIGS. 1 and 4.
Figure 5A:
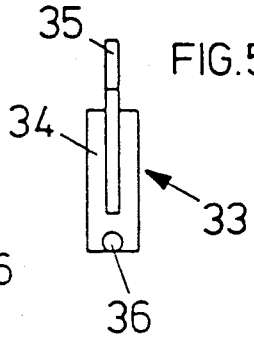
Figure 17:
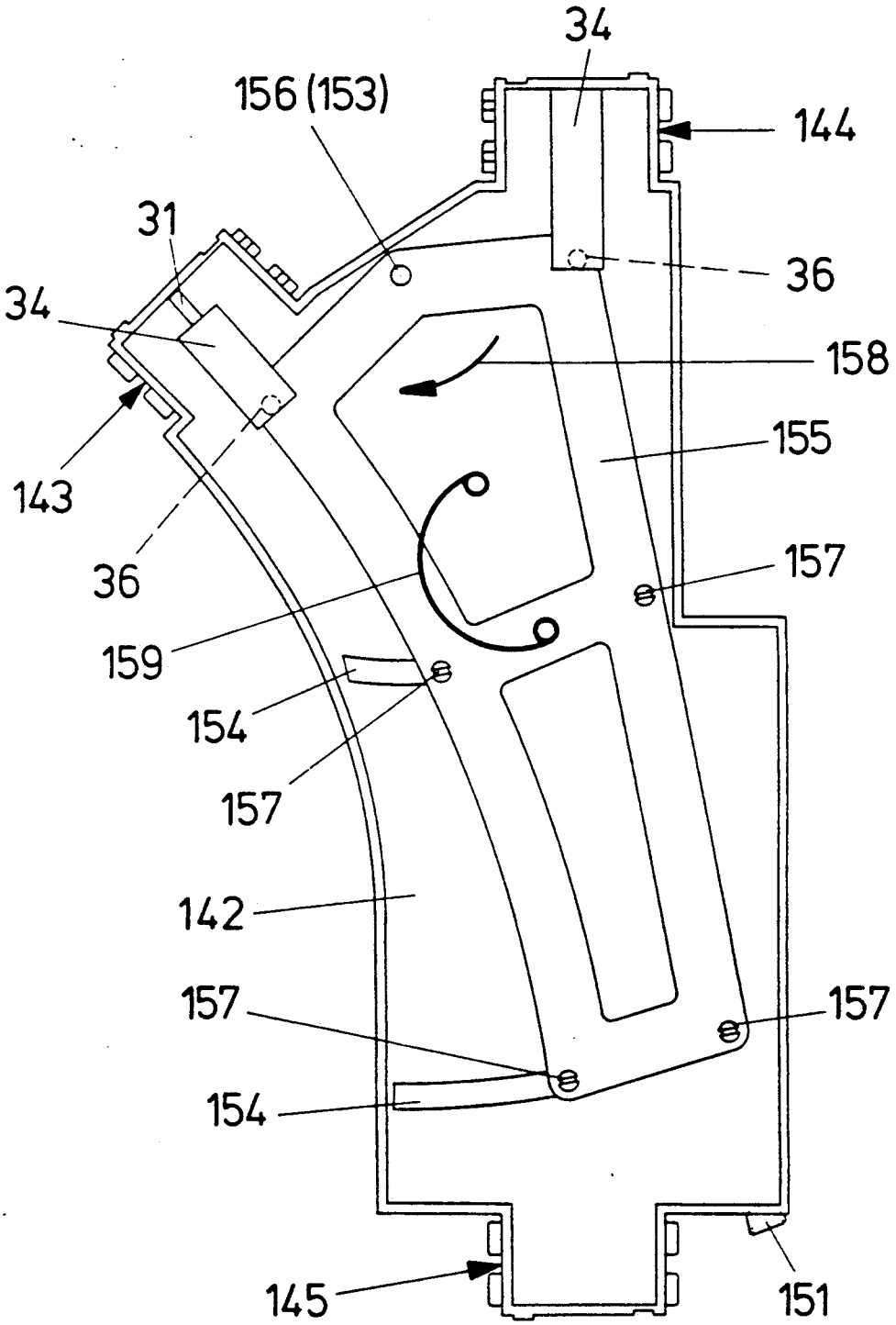
FIG. 17 is a bottom view of the right hand switch point of FIG. 16 with its lower cover removed.

Moreover, the end segments 143, 144 and 145 are essentially shaped in the same manner as the one of switch point 1, in accordance with FIG. 1, and the switch point 61 in accordance with FIG. 8. In paricular, the end segments are provided with the previously described lateral coupling pins 13 and 14 as well as with the aforedescribed protrusions 15 and the recesses 16 for coupling and connecting with subsequent track pieces. Furthermore, the end areas of the rack pieces 146 and 147 of the end segments 143 or 144 are each provided with the aforedescribed longitudinal slot 31, wherein the actuating elements 33 are displaceably mounted. Again the actuating elements 33 are provided, as illustrated in FIG. 5A and 5B, with a nose 35 (FIG. 16) and the lower longitudinal plate 34 (FIG. 17), whereby each longitudinal plate is provided with only one inwardly extending pin 36 which is indicated in FIG. 17.

The actuating elements 33 are not only displaceable in the longitudinal direction in slots 31 of rack pieces 146 and 147, but also in the vertical direction thereof. In order to control the vertical postion of the actuating elements 33, the lower cover of the upper part 142 (not illustrated in FIG. 17) is provided with a ramp-like segment in each end segment 143, 144 which connects an outer area of the cover with an inner area of the cover, whereby the two areas and the ramp like segment are formed as supports for the longitudinal plates 34 of the actuating elements 31. Thereby, as already explained in connection with FIG. 3 for the areas 37, 38 and the ramp-like segment 39 of the lower cover 3 of the switch point 1, the outer area which is closer to the upper part 142 than the inner area establishes an upper position of the actuating elements 33, at which the nose 35 of the actuating element 33 protrudes beyond the upper face of the corresponding rack piece 147. In contrast thereto, the inner area determines a lower position of the actuating element 33, at which the nose 35 of the actuating element no longer protrudes beyond the upper face of the corresponding rack piece 146 or 147. Thus, in the illustration of FIGS. 16 and 17 the nose 35 of the actuating element 33 protrudes in the end segment 144 above the rack piece 147, while in the end segment 143 is lowered to at least the level of the rack piece 146.

For an automatic actuation of the shifting device 149 of FIG. 16 the longitudinal plates 34 of the actuating elements 33 (FIG. 17) are mechanically coupled by means of a framelike element 155 with the shifting device 149. On the one hand, the frame like element 155 is pivotably mounted on a pin 156 mounted on the upper part 142 in the pivot 153 of FIG. 16, and, on the other hand, plugged onto pins 157 which protrude from the two movable rack pieces 150 and 151 at their connecting ribs 152. Furthermor, the frame-like element 155 is pivotably mounted to the longitudinal plates 34 of the two actuating elements 33 by means of the pins 36 thereof.

When a vehicle travels towards the illustrated switch point 141 and onto the straight end segment 144, it displaces the corresponding actuating element 33 inwardly, so that the framelike element 155 is pivoted in the direction of arrow 158. This causes the shifting device 149 to be pivoted in such a manner that its straight rack piece 151 connects the two stationary rack pieces 147 and 148, so that a passage of the vehicle is made possible without any problems. However, if the vehicle travels the curved end segment 143 in the position of the switch point 141 shown in FIG. 16, the position of the shifting device 149 remains unchanged since the nose 35 of the actuating element does not protrude in the end segment 143. The problemless passage over the curved rack pieces 146 and 150 is assured for this position of the shifting device 149. Naturally, the same holds true when the shifting device 149 is originally located in its other end position.

In order to retain the shifting device 149 in its two end positions, again a wire spring 159 is mounted which, during the pivot movement of the shifting device 149, is moved beyond a dead center.

In contrast to the aforedescribed actuating devices in accordance with FIGS. 1, 2, 8 and 9, the subject actuating device of FIGS. 16 and 17 has the advantage that it requires fewer coupling elements and occupies no more space. In contrast thereto, in the actuating device of FIGS. 16 and 17 the power transmission ratios are less favorable, so that the vehicle which travels the switch point must generate a larger force over a smaller stroke of the actuating element for shifting the switch point.

The actuating device described in conjunction with FIGS. 16 and 17 may be used in a corresponding left hand switch point, whereby the same frame-like element 155 is usable in a reversed position. Also, a Y-switch point may be provided with such an actuating device, which then is exactly symmetric.

A further embodiment of switch point of any type may be based on the principle of the crossing described in conjunction with the FIGS. 10 to 12. More specifically, such an embodiment is provided with a rotatable disk which is coupled with the actuating elements of the two switch point branches, whereby the two different rack pieces of the switch point are mounted or extended on the disk. It is disadvantageous in such embodiments that the rack pieces extend considerably beyond the rotatable disk at least with their one end for geometric reasons and this is the reason that they must be connected with each other or supported at these ends.

The heretofore described exemplified embodiments of the present actuating device relate to a toy cog railway which has smooth tracks with a center rack. However, it is possible that corresponding abtuating devices may also be designed for vehicles which have rimmed wheels. In the following such a design will be explained in conjunction with FIGS. 18 to 20 and by means of an example of a right hand switch point. The right hand switch point 161 illustrated in FIG. 18 in the position for straight passage and in FIG. 19 in the position for a deflected passage in plan view is provided with an upper base plate 162 which is provided with side walls 163 which are visible in FIG. 20. On the base plate 162 in the three end segments 164, 165 and 166 a straight or curved rail piece is mounted consisting of two profiled rails 167 and 168, 169 and 170 as well as 171 and 172. In case that the base plate 162 and the mentioned rails 167 to 172 should consist of a plastic, the rails 167 to 172 are preferably integrally formed with the base plate. Furthermor, it can be seen that the outer end areas of the end segments 164, 165, 166 are provided with the lateral coupling pins 13, 14 as well as with the projections 15 and the recesses 16, which were alsready described in detail in conjunction with FIG. 1.

A shifting device 173 is mounted between the end segments 164, 165, 166 which is so designed to selectively enable a straight or a deflected passage over the switch point 161 in the one or the other drive direction. The shifting device 173 contains a total of four rail pieces, namely an outer straight rail piece 174, an outer curved rail piece 175, an inner straight rail piece 176 and an inner curved rail piece 177 which is connected in a tip 178 with the inner straight rail piece 176.

The rail pieces 174 to 177 are connected with each other in pairs by transverse ribs 179, 180, 181 and 182. Thereby, the outer rail pieces 174, 175 are connected with each other by the transverse ribs 179, 180 and the inner rail pieces 176, 177 by the transverse ribs 181, 182. The transverse ribs 179 to 182 are illustrated in hatched lines of different direction so as to accentuate them in the drawings. In accordance with the illustrations of FIGS. 18 and 19 the transverse ribs 179 to 182 extend downwardly and are preferably formed integrally with the corresponding rail pieces 174, 175 or 176, 177 in the case that they are made from plastic material.

Figure 19:
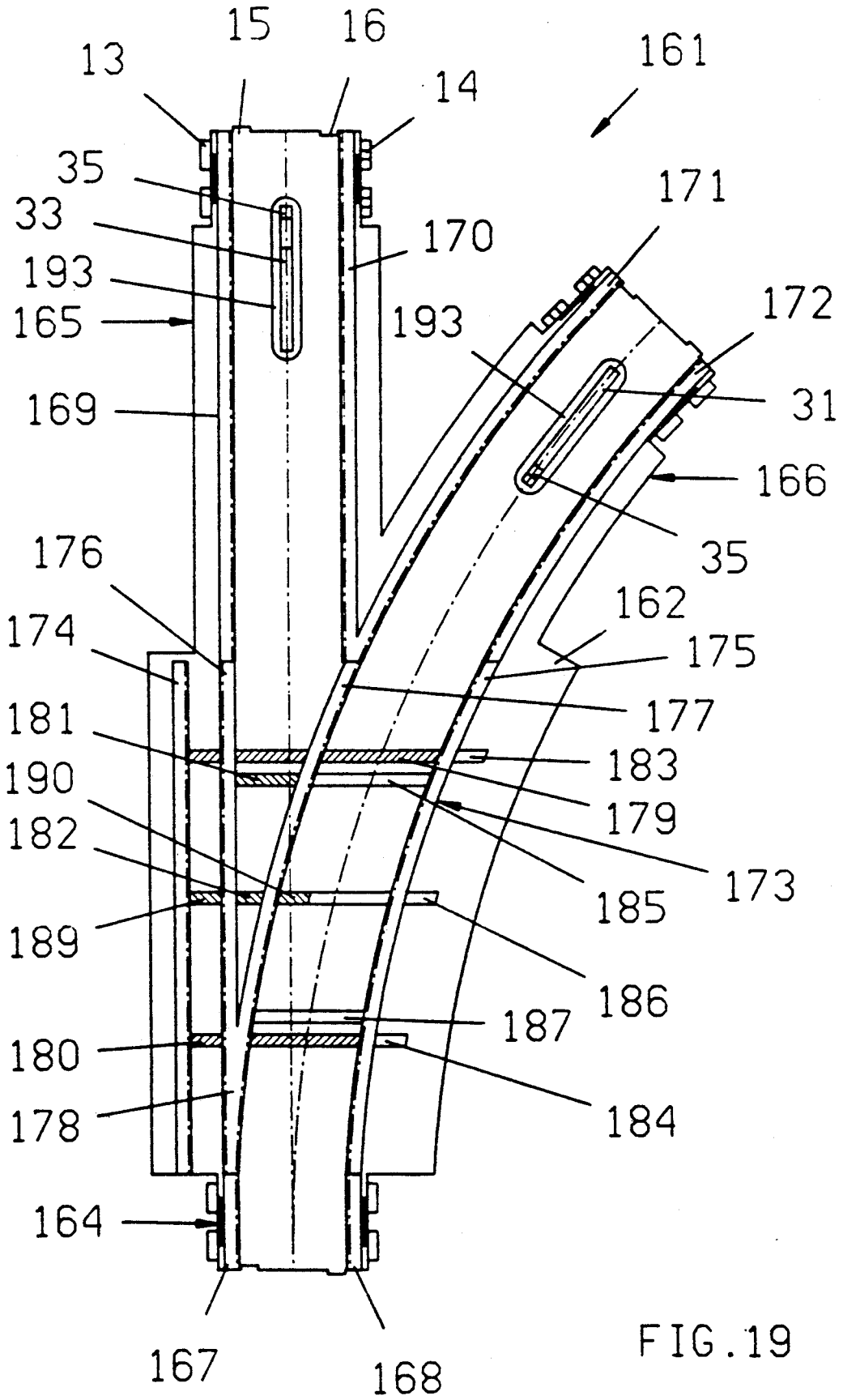
FIG. 19 is a plan view of the right hand switch point of FIG. 18 with its rail pieces disposed for a curved passing.
Figure 20:
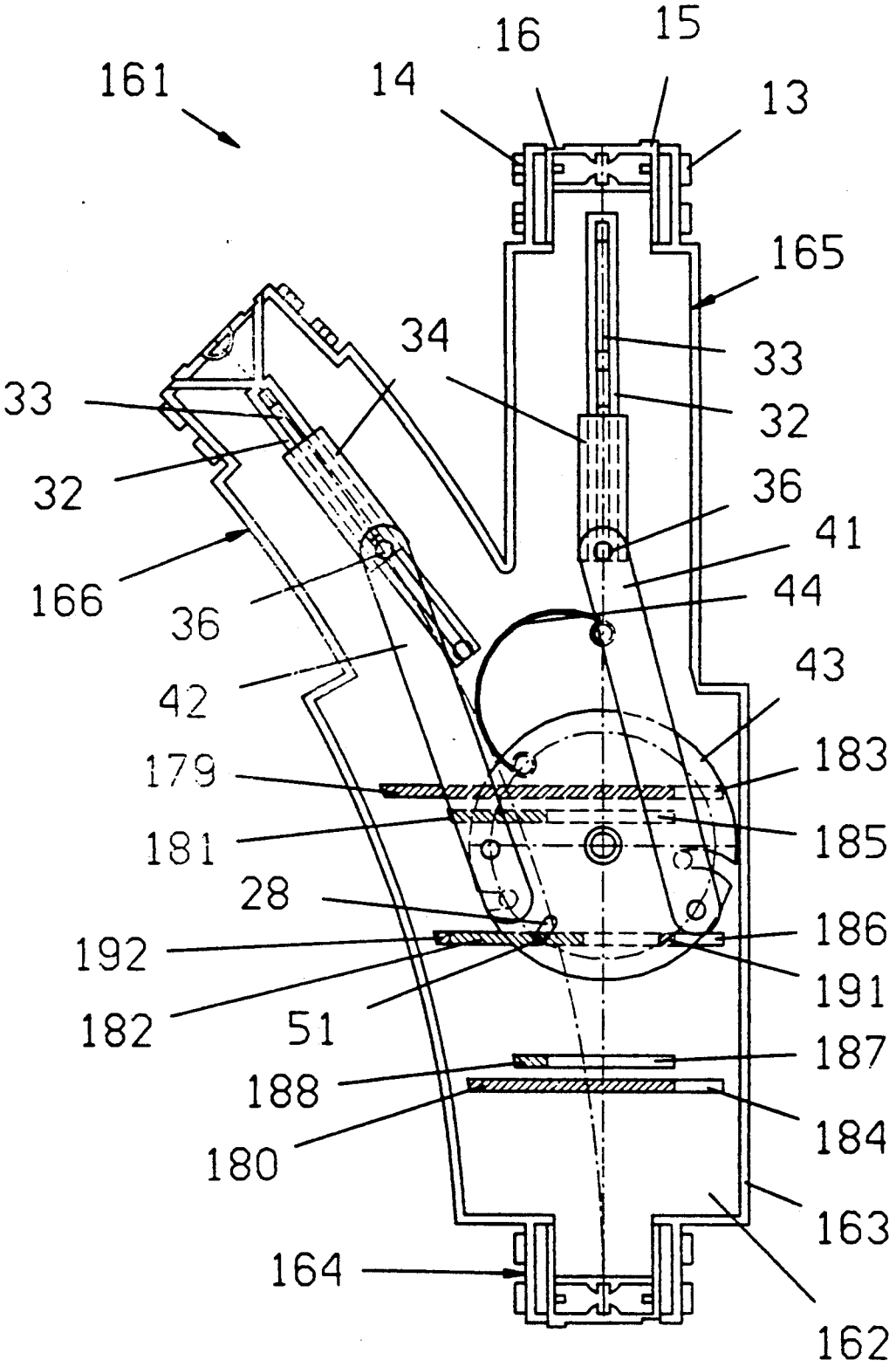
FIG. 20 is a bottom view of the right hand switch point of FIG. 18 with its lower cover removed.

The transverse ribs 179 to 182 which protrude from the feet of rail pieces 174 to 177 downwardly (FIGS. 18 and 19) or upwardly (FIG. 20) are disposed in transverse slots 183, 184, 185 or 186 of base plate 162 which are shaped as guiding slots for the transverse ribs. Furthermore, a fifth transverse slot 187 is present in base plate 162, wherein a cam 188 of the inner rail pieces 176, 177 is guided in the area of its tip 178 (FIG. 20).

Therefore, on the one hand, the inner rail pieces 176, 177 and, on the other hand, the outer rail pieces 174, 175 are displaceable in pairs in the transverse direction of the illustrated track, so as to form a continuous rail in a straight or in a deflected direction together with the stationary rail pieces 167 to 172 and the end pieces 164, 165 and 166.

As will be explained in the following in conjunction with FIG. 20, a shifting of the shifting device 173 is performed mainly by means of the inner rail pieces 176, 177 which are connected by means of the transverse ribs 181, 182 and the tip 178 and are guided in the transverse slots 185, 186 and 187. These latter rail pieces or their transverse rib 182 are in operative connection with the outer rail pieces 174, 175 which are connected with each other by transverse slots 183, 184. For this purpose the transverse rib 182 is provided at each side of its rail pieces 176, 177 with an extension 189 or 190. Moreover, the outer rail pieces 174, 175 are each provided with an elongated protrusion 191 or 192 protruding into the transverse slot 186, whereby these protrusions act as abutments for the ends of extensions 189, 190. During a transverse displacement of rail pieces 176, 177 these rail pieces displace in their last movement the rail pieces 174, 175 to the right (FIG. 18) or to the left (FIG. 19) into the position corresponding to the end position of rail pieces 176, 177.

Basically the same actuating device is provided for actuating the inner rail pieces 176, 177 and thereby positively also the outer rail pieces of the shifting device 173, as already described in all details in conjunction with FIG. 2. Accordingly, the base plate 162 is provided with longitudinal slots 31 in the end segments 165 and 166 which are limited on the lower face of the base plate 162 (FIG. 20) by lateral guide bars 32 and on the upper face by a protruding edging 193 at the level of the adjacent rail piece 169, 170 or 171, 172.

Again, a tongue-like actuating element 33 is inserted into each longitudinal slot 31 being displaceable in longitudinal direction of the longitudinal slot 31 and on which a longitudinal plate 34 (FIG. 20) is formed. As has been explained in detail in conjunction with FIG. 5B, each actuating element 33 is provided with a nose 35 which is disposed in the uppermost area of longitudinal slot 31. Morover, the longitudinal plate 34 is provided at its inner end with a pin 36 (see also FIG. 5B).

In conformity with FIG. 3 a lower cover (not shown in FIG. 20) of base plate 162 is provided with extended outer and inner areas opposite to the longitudinal slots 31 or the actuating elements 33. The actuating elements 33 are supported by these areas, as has been already explained. Thus, an actuating element 33 which together with its nose 35 is present in the outer area of an end segment 165, 166 extends above the upper edge of the edging 193 (see end segment 166 in FIG. 18 or end segment 165 in FIG. 19). However, if the actuating element 33 is in the inner area of an end segment 165, 166 (see end segment 165 in FIG. 18 or end segment 166 in FIG. 19), the nose is then lowered to at least the level of the upper edge of the edging 193.

Furthermore, it can be seen from FIG. 20 that again, as in the emodiment of FIG. 2, two levers 41 and 42, a rotating element 43 in form of a rotatable disk as well as a pretension spring 44 are provided as coupling members between the actuating elements 33 and the shifting device 173, whereby the rotating element 43 is coupled by means of a pin 51 and a longitudinal hole 28 with the transverse rib 182 of the inner rail pieces 176, 177 of the shifting device 173 in the same manner as in the exemplified embodiment of FIG. 2. Thus, a more detailed explanation of these coupling members is not required.

The mode of operation of the illustrated switch point 161 is also the same as the one of Y-switch point 1 of FIGS. 1, 2 and the right hand switch point of FIGS. 8, 9.

The illustrated switch point 161 has the advantages of a simple structure with respect to conventional track switch points with few noncritical individual parts (no switch point tongues and wheel guide rails), uninterrupted rail tracks in the given passage direction, low space requirements and an aesthetically satisfying clear design clearly showing the given passage direction.

Figure 18:
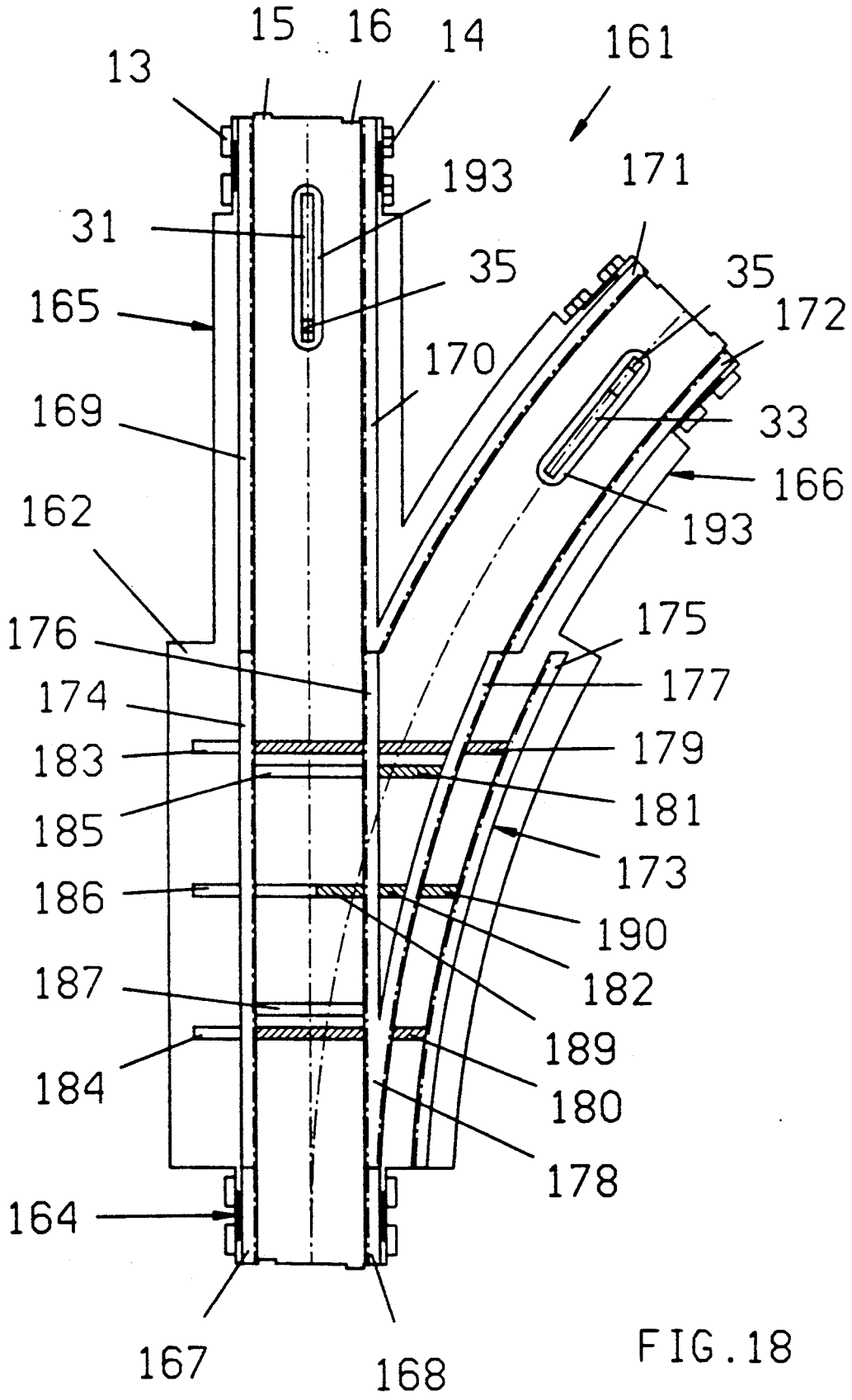
FIG. 18 is a plan view of a track assembly designed as a right hand switch point and provided with an actuating device in accordance with the present invention which is provided with its rail pieces disposed for a straight passing.

In a corresponding manner, by partially using the same structural elements, a left hand switch point or a Y-switch point may be designed. The described or mentioned track switch points may also be equipped with a preselection device, as had been described in conjunction with FIGS. 13 to 15. Moreover, it is also possible to construct a railroad crossing in accordance with FIGS. 10 to 12 and 18 to 20, when uninterrupted rail tracks are desired. This is particularly the case when the rails 167 to 172 and the rail pieces 174 to 177 are provided with teethed sections for engagement by a cog of a vehicle as indicated in FIGS. 18 and 19 by the dash dotted lines along the inner faces of the rails 167 to 172 and the rail pieces 174 to 177.

We claim:

1. An actuating device for a toy-track assembly for the mechanical shifting of a track shifting device by a vehicle travelling on a track section in a defined travelling direction, said track section having at least three end segments of track, characterized in that at least two of the end segments of said track section are each provided with an actuating element which protrudes beyond the respective track, said actuating elements being displaceably mounted in a longitudinal direction of the respective end segment, and being connected by means of coupling elements with said shifting device each said actuating element being mounted in a respective guide extending in the longitudinal direction of said respective end segment, whose limit defines the level of said actuating element above said respective track and being disposed deeper in a downstream area of the defined direction of track than in an upstream area, whereby said actuating elements as a result of said vehicle travelling in said defined direction are lowered at least to the level of said respective track.

2. The actuating device in accordance with claim 1, characterized in that each of said end segments is provided with at least one displaceable actuating element, and that each actuating element is connected with each other actuating element by means of said coupling elements in such a manner that one given actuating element protrudes beyond its track and another actuating element is at least lowered to the level of its track.

3. The actuating device in accordance with claim 1, characterized in that said track segment includes two branches forming two of said end segments, an actuating element being provided in the outer end area of each branch and that each actuating element is connected with each further actuating element by means of said coupling elements in such a manner that one given actuating element protrudes beyond its track and neither actuating element is at least lowered to the level of its track.

4. The actuating device in accordance with claim 1, characterized in that said track section is designed as a cross of two straight tracks and is shiftable by means of said shifting device for travelling on one of said given straight tracks, and that in the outer end areas of each straight forming said end segments one actuating element is provided and each actuating element is connected with each further actuating element and with said shifting device in such a manner that the actuating elements of the one straight track protrude beyond said track and that said actuating elements of the other straight track are at least lowered to the level of said track.

5. The actuating device in accordance with claims 3 or 4, characterized in that said track section is provided with tracks of a cog railway having a longitudinal geared element, said geared longitudinal element of said track section being shiftable by the shifting device.

6. The actuating device in accordance with claim 5, characterized in that each actuating element in the geared longitudinal element is disposed in the outermost end areas of said end segments.

7. The actuating device in accordance with claims 3 or 4, characterized in that said shifting device contains an element rotatably mounted in said track section which is connected with each actuating element by means of jointed levers.

8. The actuating device in accordance with claim 7, characterized in that said levers are uniformly designed and are provided with a plurality of pins, one each pin of one each level engaging into a corresponding hole of the rotating element, and the rotating element being provided with curve like slots for free movement of the pins of those levers which are not coupled with said rotating element.

9. The actuating device in accordance with claim 7, characterized in that said rotating element is provided with a spring arrangement which in two end positions of said rotating element exerts a tangential force and retains said rotating element in the respective end position.

10. The actuating element in accordance with claim 7, characterized in that said shifting device is provided with a sliding means containing said shifting device and being displaceably disposed transversely with respect to said tracks and also coupled with said rotating element.

11. Actuating device in accordance with claim 10, characterized in that said sliding means contains at least shifting segments of a geared longitudinal element of a cog railway.

12. The actuating device in accordance with claim 7 characterized in that said shifting device and said rotating element together form a pivot means movable around a rotating point containing said track piece to be shifted.

13. The actuating device in accordance with claim 12, characterized in that said pivot means is provided with a frame like element which encompasses two segments of a geared longitudinal element of a cog railway nd which in its one end area is pivotably mounted and pivoted to said actuating elements.

14. The actuating device in accordance with claim 12, characterized in that said pivot means is provided with a rotatably mounted disk which encompasses one segment of a geared longitudinal element of a cog railway and which is pivoted to said actuating elements.

15. The actuating device in accordance with claim 3 or 4, characterized in that said track section is provided with rails which are shiftable by said shifting device.

16. The actuating device in accordance with claim 15, characterized in that each actuating element is mounted between said rails of the outermost end areas of said end segments.

17. The actuating device in accordance with claim 16, characterized in that said sliding means encompasses two shiftable rail segments of a switch point.

18. The actuating device in accordance with claim 16, characterized in that said sliding means is provided with two connected inner rails and two connected outer rails of said rail segments to be shifted, whereby the inner rails are coupled with said rotating element and said outer rails are displaceable by said inner rails.

19. The actuating device in accordance with claim 3, characterized in that in the non-branched end segment of said track section two further actuating elements are provided adjacent to each other and alternately displaceable parallel with respect to each other, whereby at least one actuating element is lowered to at least the level of said track and the other actuating element either protrudes above said track or is lowered at least to the level of said track in dependency on the position of a switch point lever being coupled with said further two actuating elements, and whereby each of said further actuating elements is coupled with a corresponding actuating element of said one or said other track branch of said track section and with said shifting device.

20. The actuating element in accordance with claim 19, characterized in that said switch point lever is coupled with two actuating levers pivotably mounted laterally with respect to said track, whereby each lever is provided with a ramp on its free end which can be brought beneath said one or said other of said further actuating elements depending on the position of said track section, so as to lift the corresponding actuating element, whereby the actuating levers are yieldingly mounted in the heightwise direction.

21. A switch point for a toy-track assembly along which a vehicle (84) which is guided along a guide element (85) of a track (86), the switch point (1,61,71,91,141,161) comprising at least three end segments of track, each of said end segments having a free end adapted to be connected to an adjoining track piece of said track assembly and each of said end segments containing (6,7,8;66,67;72–75;143–145;164–166) a stationary guide element section (10;78,79;92,93,96;146–148;167–172) and at least one movable guide element piece (19,20;62,63;80;150,151;174–177) disposed between the end segments, the guide element piece being movable between a first position in which it is aligned at both of its ends with a respective one of said guide element sections and a second position in which none of its ends are aligned with the same guide element sections, wherein at least two of the end segments comprise an actuating element (33,94) each displaceable in the longitudinal direction of the guide element section of the respective end segment in a guide (31) between an extended position and a retracted position, the extended position being in than the retracted position, wherein each of said actuating elements is coupled to said movable guide element piece such that in both positions of the guide element piece at least one of said actuating elements is in the extended and at least a further one of said actuating elements is in the retracted position, wherein each of said actuating elements comprises a nose means for engagement by a vehicle, and wherein each said guide comprises a guide section proximate its end corresponding to the retracted position of the respective actuating element, said guide section being inclined with respect to the longitudinal direction of the respective guide element section such that the nose means in the retracted position of the respective actuating element is out of the range of engagement by the vehicle.

22. A switch point according to claim 21, comprising four of said end segments (72–75) forming a crossing of two tracks, wherein each of said end segments comprises one of said actuating elements (33), wherein said movable guide element piece (80) is pivotable about an axis disposed perpendicularly to a common plane of said end segments, the guide element piece in both of its positions interconnecting two diametrically opposed of said guide element sections (78,79) in said end segments, and wherein the two actuating elements (33) of the interconnected end segments are in their retracted position and the other two actuating elements are in the extended position.

23. A switch point according to claim 21, wherein the guide element sections (10;78,79;92,93,96;146–148;167–172) and the movable guide element piece (19,20;62,63;80;150,151; 174–177) comprise a rack for engagement by a cogwheel (87) of the vehicle (84).

24. A switch point according to claim 23, wherein the guide element sections (10;78,79;92,93,96;146–148) and the movable guide element piece (19,20;62,63;80;150,151) are racks with teeth on both sides extending perpendicularly to a common plane of said end segments, wherein the actuating elements (33,94) are guided in a longitudinal slot (31) in the guide element sections, and wherein the nose means (35,95) in the extended position of the actuating elements (33,94) protrude above the upper surface of the respective guide element section.

25. A switch point according to claim 21, wherein each actuating element (33,94) is connected by a lever (41,42; 107,108) with a swivel element (43;81;110;155) that is pivotable between two end positions about an axis extending perpendicularly to a common plane of said end segments, and wherein the swivel element is coupled to the movable guide element piece (19,20;62,63;80;150,151;174–177).

26. A switch point according to claim 25, wherein the swivel element (43;81;110;155) is biased into its end positions by a spring (44,130,159), the spring passing over a dead center when the swivel element pivots from one to the other of its end positions.

27. A switch point according to claim 21, comprising three of said end segments (6,7,8;66,67;143–145;164–166) and two of said guide element pieces (19,20;62,63;150,151;174–177) rigidly connected to one another and commonly movable, a first one of said guide element pieces in the first position of the guide element pieces connected the stationary guide element sections (10;92,93,96;146–148;167–172) of the first and second end segment, and a second one of said guide element pieces in the second position of the guide element pieces connecting the stationary guide element sections of the first and third end segment, wherein said actuating elements (33,94) are disposed in the second and third end segment.

28. A switch point according to claim 27, wherein each actuating element (33,94) is connected by a lever (41,42;107, 108) with a swivel element (43;81;110;155) that is pivotable between two end positions about an axis extending perpendicularly to a common plane of said end segments, wherein the two movable guide element pieces are mounted to a holder (21–23; 179–182) which is slidable transversely to the longitudinal extension of the guide element pieces, and wherein the holder is coupled to the swivel element.

29. A switch point according to claim 27, wherein the first end segment comprises two further actuating elements (98,99) which are movable longitudinally of the guide element section (96) of the first end segment and coupled to the first two actuating elements (33) such that one of the further actuating elements is in the retracted and the other one in the extended position, wherein further nose means (100) of the further actuating elements in the retracted position of the further actuating elements are out of the range of engagement by the vehicle, and wherein the further actuating element which is in the extended position is laterally shiftable by a control element (101) selectively between a first position for engagement by the vehicle and a second position out of the range of engagement by the vehicle.

30. A switch point according to claim 27, wherein each guide element section comprises two stationary, spaced apart, parallel rails (167–172), wherein the guide element piece is composed of a first pair of laterally movable, rigidly interconnected inner rails (176,177) and a second pair of laterally movable, rigidly interconnected outer rails (174, 175), wherein the first pair is laterally displaceable relative to the second pair within limits, wherein the transverse movement of the second pair with respect to the stationary rails is limited such that in one limit the one rail (174) of the second pair is aligned with the outer stationary rails (167,169) of the first and second end segment (164, 165) and in the other limit the other rail (175) of the second pair is aligned with the outer stationary rails (168,172) of the first and third end segment (164,166) and wherein the actuating elements (33) are coupled with the first pair of movable rails (176,177).

* * * * *